US007578591B2

(12) United States Patent
Kent et al.

(10) Patent No.: US 7,578,591 B2
(45) Date of Patent: Aug. 25, 2009

(54) FILING, IDENTIFYING, VALIDATING, AND SERVICING TIP FOR FLUID-EJECTION DEVICE

(75) Inventors: Blair M. Kent, Vancouver, WA (US); James P. Axtell, Vancouver, WA (US); Trudy Benjamin, Vancouver, WA (US); David Lowe, Vancouver, WA (US); Preston Seu, Sammish, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 457 days.

(21) Appl. No.: 11/532,059

(22) Filed: Sep. 14, 2006

(65) Prior Publication Data

US 2008/0068435 A1 Mar. 20, 2008

(51) Int. Cl.
*B41J 3/36* (2006.01)

(52) U.S. Cl. ..... 347/109

(58) Field of Classification Search ..... 347/109
See application file for complete search history.

(56) References Cited

U.S. PATENT DOCUMENTS 5,663,754 A 9/1997 Lorenze, Jr. et al.
5,883,338 A * 3/1999 Trunck et al. ..... 178/19.07
6,158,851 A 12/2000 Zepeda
6,213,598 B1 4/2001 Hou et al.
6,749,355 B2 * 6/2004 Payne et al. ..... 401/195
2004/0176705 A1 * 9/2004 Stevens et al. ..... 600/584
2005/0128260 A1 6/2005 Su et al.
2005/0225610 A1 10/2005 Ginskey

FOREIGN PATENT DOCUMENTS

WO 0187629 11/2001
WO 0234531 5/2002

OTHER PUBLICATIONS

Invitation to Pay Additional Fees and Communication Relating to the Results of the Partial International Search dated Mar. 18, 2008.

* cited by examiner

*Primary Examiner*—Julian D Huffman
*Assistant Examiner*—Kar Yip

(57) ABSTRACT

A tip to be placed on a fluid-ejection device is filled with fluid. The fluid may be introduced into a substantially hollow body of the tip at a first end of the body. The body of the tip has a second end at which a fluid-ejection mechanism is disposed to eject the fluid as controlled by the fluid-ejection device. The fluid may be introduced into the substantially hollow body of the tip through of the fluid-ejection mechanism disposed at the second end of the body of the tip. The tip may further be identified and/or serviced, and the tip and/or the fluid-ejection device my further be validated.

7 Claims, 19 Drawing Sheets

FILING, IDENTIFYING, VALIDATING, AND SERVICING TIP FOR FLUID-EJECTION DEVICE

BACKGROUND

Fluid-ejection devices are commonly used as inkjet printers to eject ink. However, research has been conducted to employ fluid-ejection devices for other applications as well. The small drops of fluid ejected by fluid-ejection devices can make them desirable as fuel injectors for motor vehicles, as pheromone ejectors for insect-control purposes, as frosting dispensers for cakes, as well as a variety of other purposes.

An issue with attempting to employ existing fluid-ejection devices, namely inkjet printers, for other applications is that developers have to purchase an inkjet printer and attempt to modify it for an alternative application. This process can be time-consuming, difficult, and expensive. As a result, potential utilization of fluid-ejection devices for non-printing purposes is inhibited.

DETAILED DESCRIPTION OF THE DRAWINGS

Fluid-Ejection Device with Tip

Figure 1:
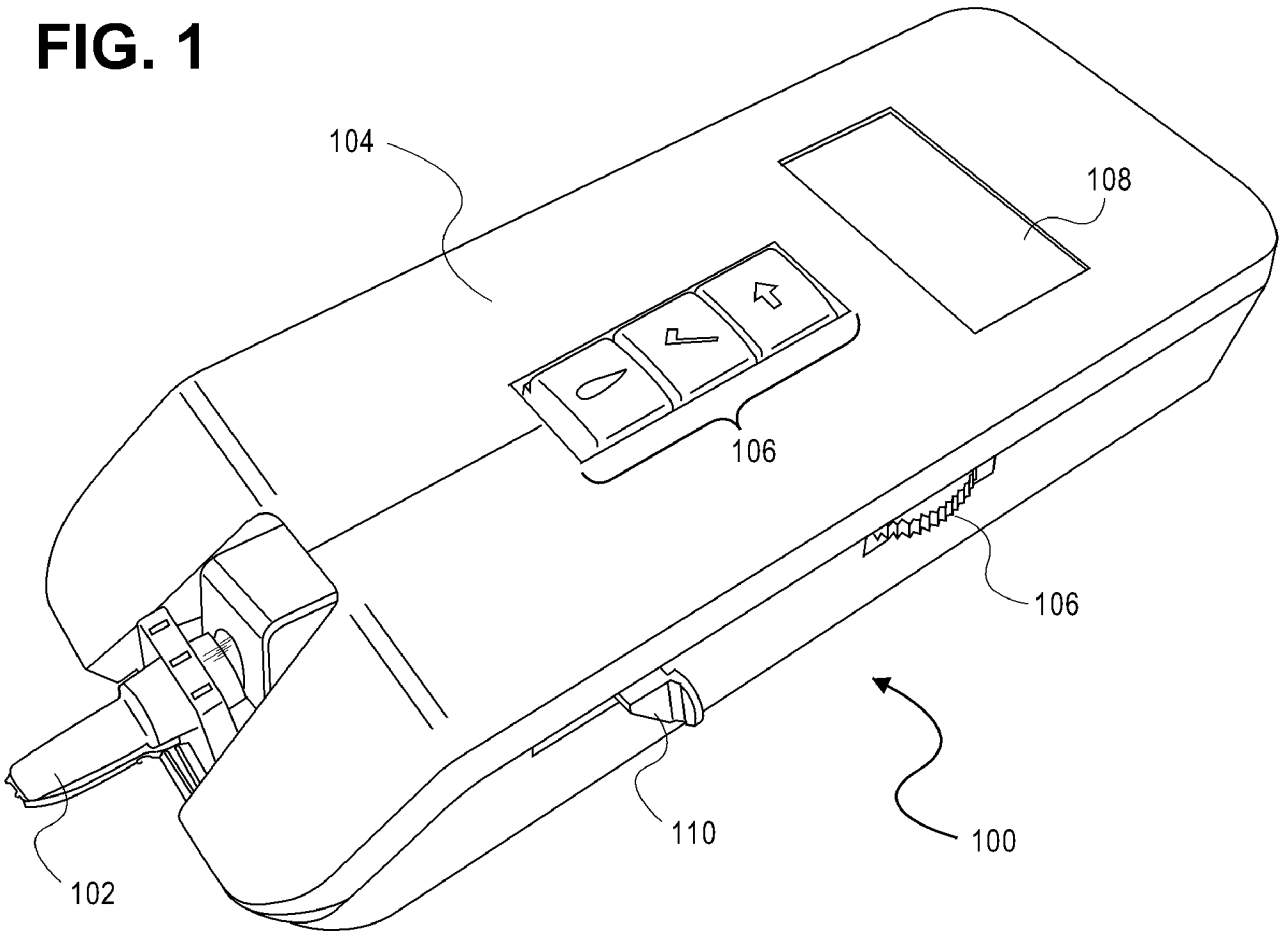
FIG. 1 is a diagram of a handheld and/or mountable fluid-ejection device on which a tip has been placed, according to an embodiment of the invention.

FIG. 1 shows a handheld and/or mountable fluid-ejection device 100 on which a tip 102 has been placed, according to an embodiment of the invention. The fluid-ejection device 100 is mountable in that it can be attached to a wall, bracket, or other object via screws, adhesive, or other mounting mechanisms. The fluid-ejection device 100 is handheld in that it can be easily held in place over a desired location by a user with just one hand while the device 100 is causing the tip 102 to eject one or more drops of fluid.

By comparison, conventional fluid-ejection devices, such as inkjet printers, and even portable fluid-ejection devices, are not intended to be held in the hand of a user while ejecting ink. Even if such conventional fluid-ejection devices can be held in the hand of a user while ejecting ink, the devices do not eject fluid at desired locations over which the devices are held. Rather, these conventional fluid-ejection devices typically eject fluid on media inserted or being transported through the devices. As such, the locations over which these fluid-ejection devices are held are not the locations onto which fluid is ejected.

Furthermore, conventional fluid-ejection devices that are handheld are primarily airbrushes in effect, providing airbrush-type functionality. By comparison, as described herein, the fluid-ejection device 100 provides for precise metering of fluid, measurable in fluid droplets and/or relatively small volumes of fluid. Furthermore, in comparison to the prior art, the fluid-ejection device 100 provides for individual control of fluid-ejection nozzles of the device 100 in their ejection of fluid. Conventional handheld fluid-ejection devices in contradistinction eject a substantially continuous large amount of fluid so that such devices can function as airbrushes.

The fluid-ejection device 100 includes an enclosure 104, which is the part of the device 100 that is handheld and/or mountable. The enclosure 104 may be fabricated from plastic or another type of material. The fluid-ejection device 100 includes a user interface made up of a number of user-actuable controls 106 and a display 108. The controls 106 may be buttons and/or scroll wheels that are disposed within and extend through the enclosure 104, such that they are externally exposed as depicted in FIG. 1. The display 108 may be a liquid-crystal display (LCD), or another type of display, and is also disposed within and extends through the enclosure 104, such that it is externally exposed as well.

The fluid-ejection device 100 uses the display 108 to display information regarding the tip 102 placed on the device 100, among other types of information. The user is able to use the fluid-ejection device 100 to eject fluid from the tip 102 via the controls 106, with informational feedback provided on the display 108. The user can use the device 100 to eject fluid from the tip 102 on a stand-alone basis, without the fluid-ejection device 100 being connected to another device, such as a host device like a desktop or laptop computer, a digital camera, and so on. That is, the device 100 can be intended for use on a completely stand-alone basis, where the user controls fluid ejection from the tip 102 placed on the device 100 without having to connect the device 100 to a host device.

Furthermore, such usage of the fluid-ejection device 100 on a stand-alone basis includes desired fluid ejection in addition to fluid ejection for calibration and testing purposes. For example, some conventional fluid-ejection devices, namely inkjet printers, can eject fluid without having to be communicatively coupled to another device. However, except where a memory card having images stored thereon has been inserted into such a fluid-ejection device, the fluid ejection by these conventional devices is typically restricted to calibration and testing purposes. Fluid is thus ejected to ensure that a given conventional fluid-ejection device is working properly, and to otherwise calibrate the device. Such a conventional device, however, is ultimately intended for usage to eject fluid as directed by another device, such as printing images on media as directed by a computing device, or printing images from a memory card inserted into the fluid-ejection device. By comparison, the fluid-ejection device 100 is capable of and intended for usage to eject fluid without having to be directed by another device and without having to have a memory card inserted thereinto, apart from calibration and testing purposes.

The fluid-ejection device 100 further includes an ejection control 110. User actuation of the ejection control 110 causes the tip 102 to be ejected from the fluid-ejection device 100, without the user having to directly pull or pry the tip 102 from the device 100. In this way, if the tip 102 contains a caustic or other type of fluid with which user contact is desirably not made, it can be disposed of by simply positioning the fluid-ejection device 100 over a proper waste receptacle and ejecting the tip 102 from the device 100 into the waste receptacle.

The tip 102 placed on the fluid-ejection device 100 contains the fluid to be ejected and the actual fluid-ejection mechanism, such as an inkjet printhead. That is, the fluid-ejection device 100 in at least some embodiments does not store any supply of fluid, and does not perform the actual fluid ejection, but rather causes the tip 102 to eject the fluid from its fluid-ejection mechanism. In this way, the fluid-ejection device 100 can remain free of contact with the fluid ejected from the tip 102, even during ejection of the fluid by the tip 102.

As such, the fluid-ejection device 100 is not ever contaminated with fluid, and thus different tips containing different fluids and/or different types of fluid-ejection mechanisms can easily be switched off and on the device 100 to eject these different fluids in different ways, without having to clean the fluid-ejection device 100. For example, a user may maintain a number of different tips containing different fluids that the user may desirable want to eject. As another example, a user may maintain a number of different tips that contain different types of fluid-ejection mechanisms. The mechanisms, for instance, may vary from one another in that they can deliver different drop volumes of the fluid in a single ejection.

In general, the fluid-ejection device 100 having the tip 102 placed thereon is able to cause ejection of fluid from the tip 102 in drops having volumes measurable in picoliters. For example, the drops may be between 2-300 picoliters, or even between 1-500 picoliters, in volume. By comparison, conventional pipette technology, which is employed to jet individual drops of fluid for fluid analysis and other purposes, can at best eject drops having volumes measurable in microliters. As such, the fluid-ejection device 100 is advantageous over conventional pipette technology for this application, because it can dispense fluids in drops that are approximately a million times smaller than conventional pipette technology. Newer pipette technology has been developed that can eject drops having volumes measurable in nanoliters, but such devices are prohibitively expensive, and indeed the fluid-ejection device 100 can still thus dispense fluids in drops that are approximately a thousand times smaller.

Furthermore, the fluid-ejection device 100 is useful for conducting experiments as to the viability of employing fluid ejection for new applications. Rather than having to purchase a fluid-ejection device suited for a particular purpose, like inkjet printing, and then disassembling the device and modifying it for new applications, a user just has to fill the tip 102 with the desired fluid to conduct the experiments. As such, research into employing fluid-ejection devices for different applications is conducted more easily and more cost-effectively than in the prior art.

In addition, the fluid-ejection device 100 is useful for investigating what types of tips and what parameters for controlling the tips are appropriate to eject drops of different fluids at different volume levels. For example, an application may be in development in which a given type of fluid, having particular properties, is to be ejected at a given volume level. By using different types of tips having different nozzle sizes and/or different numbers of nozzles, and by controlling these tips using different parameters, the appropriate tip and the appropriate parameters can be determined for the desired application using a given type of fluid. Such parameters can include the energy, power, voltage, and/or current provided to the tip, and the length of time (i.e., the pulse width) at which this energy, power, voltage, and/or current is so provided, for desired ejection of the given type of fluid from a particular tip. Other parameters include the temperature at which the fluid is ejected, as well as pulse frequency.

For example, different energies may be needed to eject fluid at volumes of about one picoliter as compared to at volumes of about 300 picoliters. Different types of fluids further need different energies to eject these fluids, even at the same volumes. As such, the fluid-ejection device 100 allows the user to adjust different parameters to ensure that a given type of fluid is appropriately ejected at a desired volume, and thus to determine the values of these parameters for optimal ejection of a given type of fluid.

Fluid-Ejection Device in Detail

Figure 2:
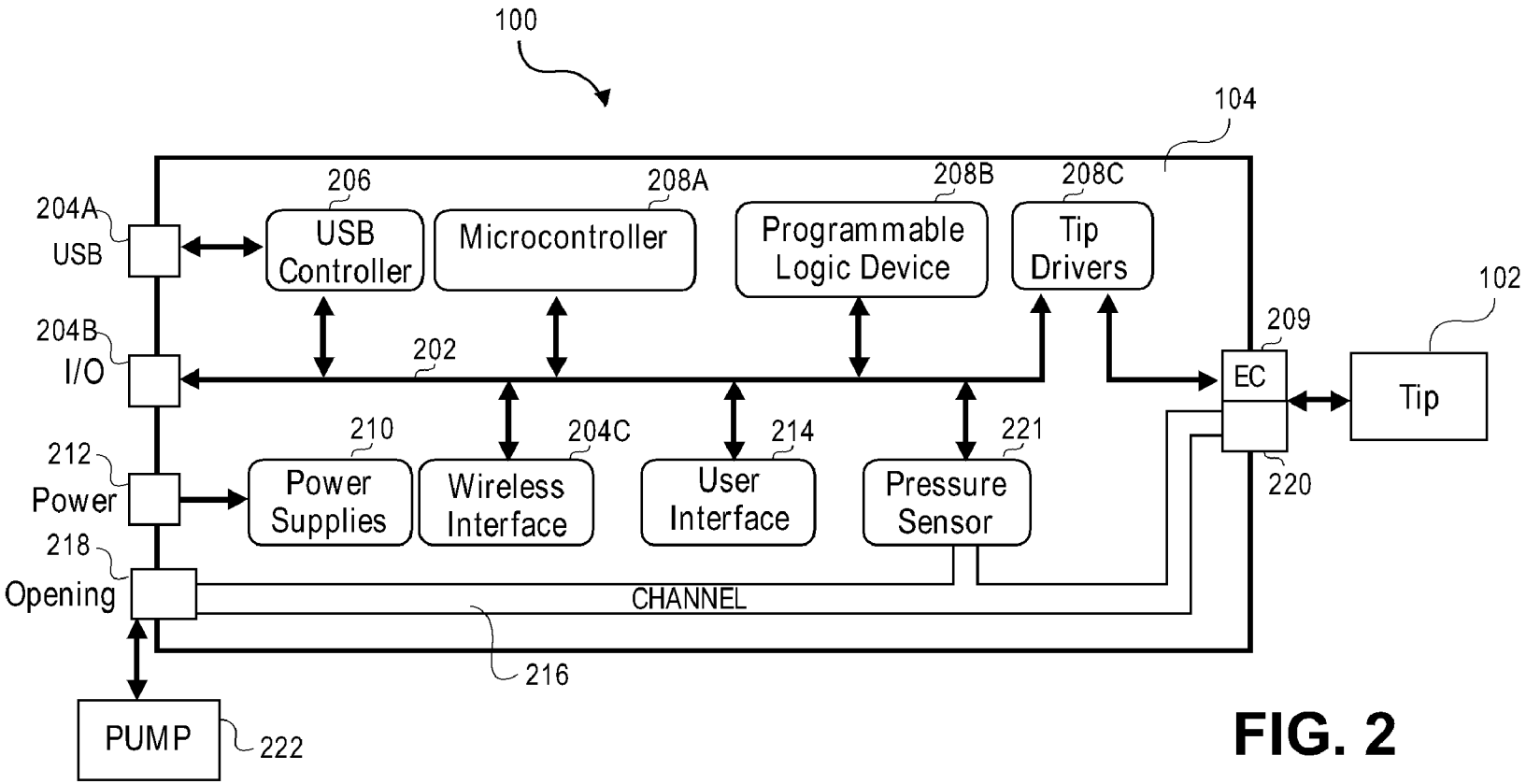
FIG. 2 is a functional diagram of the components of a fluid-ejection device on which a tip can be placed, according to an embodiment of the invention.

FIG. 2 shows a functional block diagram of the fluid-ejection device 100 depicting at least some of the constituent components of the device 100, according to an embodiment of the invention. The components of the fluid-ejection device 100 as described in relation to FIG. 2 are disposed at, reside within, and/or extend through the enclosure 104 of the device 100. The fluid-ejection device 100 may have other components, in addition to and/or in lieu of those depicted in FIG. 2, and the device 100 may not have all the components shown in FIG. 2 in some embodiments of the invention.

The fluid-ejection device 100 includes a communication bus 202. Indirectly or directly connected to the communication bus 202 are a number of interfaces 204A, 204B, and 204C, collectively referred to as the interfaces 204, of the fluid-ejection device 100. The interface 204A is a Universal Serial Bus (USB) interface, as known within the art, which connects to the communication bus 202 via a USB controller 206 of the fluid-ejection device 100. The USB controller 206 is a specialized hardware component to provide for USB communications. The interface 204B is a general input/output (I/O) interface, and may be a serial interface, such as an RS-232, RS-422, or RS-485 interface, a 1-Wire® interface, as known within the art, or another type of I/O interface. The interface 204C is a wireless interface, such as a Wi-Fi, 802.11a, 802.11b, 802.11g, 802.11n, and/or a Bluetooth wireless interface, or another type of wireless interface.

The interfaces 204 at the enclosure 104 enable the fluid-ejection device 100 to be communicatively coupled to another device to control ejection of fluid by the tip 102, and/or to receive information regarding the tip 102 placed on the device 100, among other types of information. As has been described, the fluid-ejection device 100 can be employed on a stand-alone basis without being communicatively coupled to another device to cause the tip 102 to eject fluid. However, in another embodiment, the interfaces 204 enable other devices to communicatively couple to the fluid-ejection device so that these other devices effectively control ejection of fluid by the tip 102. These other devices may include computing devices, such as laptop or desktop computers, as well as more specialized types of devices.

The fluid-ejection device 100 also includes a number of controller components 208A, 208B, and 208C, collectively referred to as the controller components 208, situated within the enclosure 104, and communicatively coupled to the communication bus 202. The controller components 208 may constitute what is referred to herein as a controller. Generally, the controller is that which causes the tip 102 to eject fluid. More specifically, the controller component 208A is a general-purpose, readily available microcontroller that is employed to handle most slower-speed communications and functionality within the fluid-ejection device 100. By comparison, the controller component 208B is a programmable logic device (PLD) that is employed to handle faster-speed communications and functionality within the fluid-ejection device 100, as may be needed, for instance, to accommodate for the relatively fast triggering of the fluid-ejection mechanism of the tip 102 to eject fluid.

While the functionality of the controller component 208B can be subsumed into the controller component 208A, it is desirable to breakout the functionality of the controller component 208B separately, or otherwise the controller component 208A would have to be a more expensive, faster-speed microcontroller. Likewise, the functionality of the controller component 208A can be subsumed into the controller component 208B, but it is desirable to breakout the functionality of the controller component 208A separately. This is because the controller component 208B is a relatively more expensive PLD that would have to be even more expensive if it were to include the functionality of the controller component 208A.

The controller component 208A may include a table that describes the different types of tips that may be placed on the fluid-ejection device 100. Such a table includes entries corresponding to how much current, voltage, energy, or power to deliver to a given type of tip to cause it eject fluid, how long such current, voltage, energy or power should be delivered to result in a given type of tip to eject fluid, and so on. More generally, the entries of the table describe parameters as to how different types of tips are to be signaled so that they properly eject fluid under the control of the fluid-ejection device 100.

Furthermore, the controller component 208C can be considered as including tip drivers. These tip drivers may be a set of hardware devices or components for buffering signals passed to and from the tip 102 in relation to the fluid-ejection device 100. The fluid-ejection device 100 is electrically connected to the tip 102 via an electrical connector 209. More specifically, the communication bus 202 of the fluid-ejection device 100 is connected to the tip 102, through the controller component 208C, via the electrical connector 209. Communications signals from the fluid-ejection device 100 are transmitted to and received from the tip 102 via the electrical connector 209. Furthermore, power is provided to the fluid-ejection mechanism of the tip 102 from the fluid-ejection device 100 via the electrical connector 209.

The fluid-ejection device 100 is further depicted in FIG. 2 as including a power supply 210 within the enclosure 104, and that is connectable to a power interface 212 extending through the enclosure 104. The power supply 210 provides power to the components of the fluid-ejection device 100 as supplied by an external power source through a power cable connected to the power interface 212. Alternatively, the power supply 210 may be external to the enclosure 104 of the fluid-ejection device 100. Furthermore, the power supply 210 may in one embodiment include one or more rechargeable and/or non-rechargeable batteries, in addition to and/or in lieu of being connectable to an outside power source via a power cable connected to an external power source.

The fluid-ejection device 100 is also depicted in FIG. 2 as including a user interface component 214. The user interface component 214 resides or is disposed within the enclosure 104, and/or extends through the enclosure 104. The user interface component 214 includes the controls 106 and the display 108 of FIG. 1 that have been described, and is communicatively connected to the communication bus 202.

The fluid-ejection device 100 includes a gas channel 216 disposed or situated within the enclosure 104. The gas channel 216 may be externally exposed at an opening 218 within the enclosure 104 of the fluid-ejection device 100. At the other end, the gas channel 216 ends at a pneumatic fitting 220 to which the tip 102 is pneumatically connected. When the fluid is ejected from the tip 102, the fluid can be effectively replaced within the tip 102 with air (or another gas) supplied via the channel 216 from the opening 218, as can be appreciated by those of ordinary skill within the art. Otherwise, undesired negative air (or gas) pressure may build up within the tip 102 as its supply of fluid is ejected.

Generally, where the fluid-ejection device 100 is operated within a conventional environment, the gas supplied via the channel 216 is air from this environment. However, in other environments, the fluid-ejection device 100 may be operated such that the surrounding gas is other than air. For instance, such an environment may be constrained to an inert gas, such that the gas supplied via the channel 216 is this inert gas.

The gas channel 216 is fluidically, or pneumatically, connected to a pressure sensor 221 also disposed or situated within the enclosure 104 of the fluid-ejection device 100, and communicatively coupled to the communication bus 202. The pressure sensor 221 measures the air, or gas, pressure against the fluid within the tip 102 via the fluidic connection of the channel 216 with the tip 102 through the pneumatic fitting 220. The pressure sensor 221 can thus measure if there is positive air (or gas) pressure or negative air (or gas) pressure against the fluid within the tip 102.

The gas channel 216 may also be fluidically, or pneumatically, connected to a pump 222. The pump 222 is depicted as being external to the enclosure 104 of the fluid-ejection device 100, and fluidically, or pneumatically, coupled at the opening 218. Alternatively, the pump 222 may be internal to the enclosure 104 of the fluid-ejection device 100. In either case, the pump 222 may in one embodiment be considered part of the fluid-ejection device 100. The pump 222 can be employed to create positive pressure against the fluid contained within the tip 102, by pumping air (or another gas) to the tip 102 via the pneumatic fitting 220 through the channel 216. The pump 222 can also be employed to create negative pressure against the fluid contained within the tip 102, by pumping air (or another gas) from the tip 102 via the pneumatic fitting 220 through the channel 216.

Figure 3A:
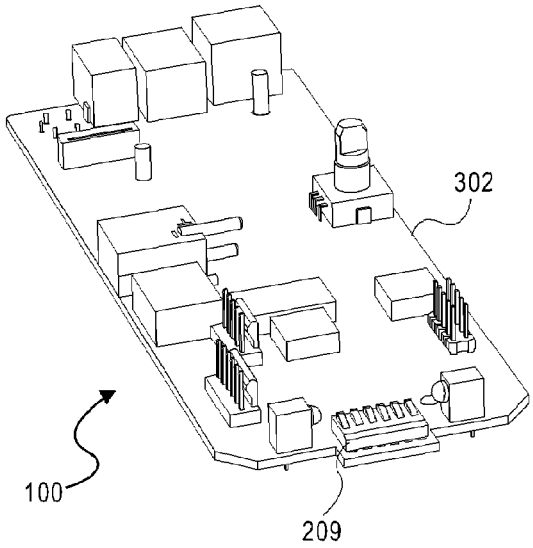
FIGS. 3A, 3B, and 3C are diagrams of a printed circuit board of a fluid-ejection device on which a tip can be placed, a portion of an enclosure of the fluid-ejection device, and the printed circuit board as mounted within the portion of the enclosure, according to varying embodiments of the invention.
Figure 3B:
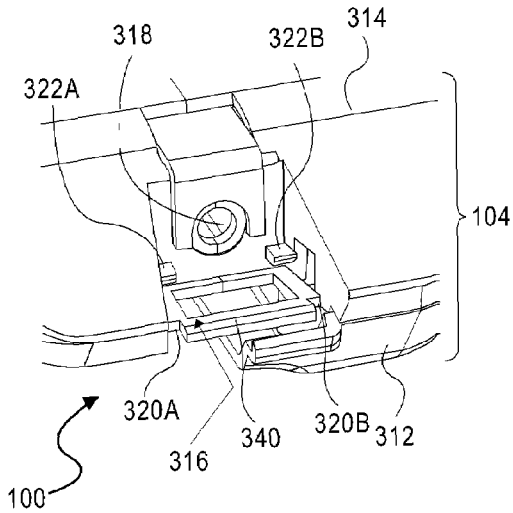
Figure 3C:
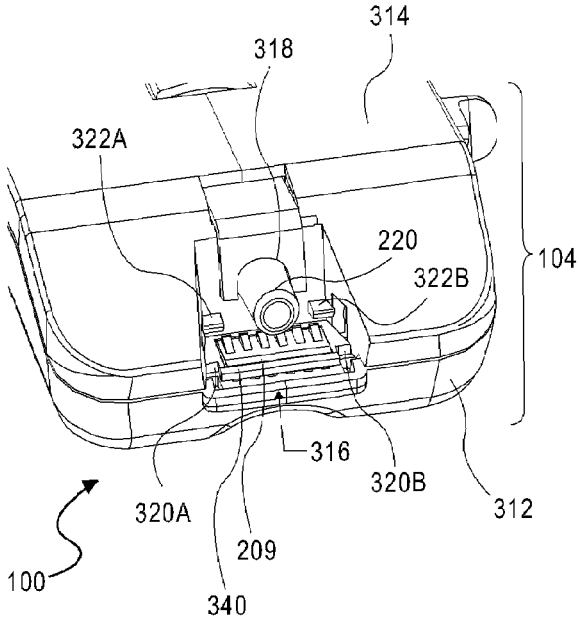

FIGS. 3A, 3B, and 3C show a printed circuit board 302 of the fluid-ejection device 100, a portion of the enclosure 104 of the fluid-ejection device 100, and the printed circuit board 302 as mounted within the portion of the enclosure 104, according to varying embodiments of the invention. In FIG. 3A, the printed circuit board 302 is particularly depicted as having the electrical connector 209 disposed thereon. Furthermore, the interfaces 204, the USB controller 206, the controller components 208, the power supply 210, the power interface 212, and the pressure sensor 221 may be disposed on the printed circuit board 302 although these components are not particularly called out in FIG. 3. By comparison, the gas channel 216 and the pneumatic fitting 220 may be free-standing components, in that they are not attached to the printed circuit board 302 in one embodiment.

In FIGS. 3B and 3C, a portion of the enclosure 104 of the fluid-ejection device 100 is depicted as including parts 312 and 314 that are secured to one another to realize the enclosure 104. The printed circuit board 209 may be disposed between the parts 312 and 314, and in one embodiment is not physically attached or mounted to either the part 312 or the part 314. The part 314 includes a slot 316 within which the electrical connector 209 extends through the enclosure 104. However, the electrical connector 209 is not attached to the part 314. Rather, a pair of alignment ribs 320A and 320B, collectively referred to as the ribs 320, are situated to either side of the slot 316, and secure and locate the electrical connector 209 from side to side within the slot 316. In addition, a beveled edge 340 is present between the ribs 320, and surrounds the front of the electrical connector 209. The beveled edge 340 assists in ensuring that parallel alignment of an electrical connector of the tip 104 with respect to the electrical connector 209 when the tip 104 is placed on the fluid-ejection device 100.

Furthermore, the part 314 of the enclosure 104 of the fluid-ejection device 100 includes an opening 318 through which the pneumatic fitting 220 of fluid-ejection device 100 extends. The alignment ribs 320 are aligned with the opening 318 such that the electrical connector 209 is aligned by the ribs 320 relative to the pneumatic fitting 220 extending through the opening 318. That is, because the pneumatic fitting 220 is not in one embodiment attached to the printed circuit board 302, locating the opening 318 in aligned relation to the ribs 320 ensures that the connector 209 is properly aligned relative to the pneumatic fitting 220. This ensures that there is secure electrical coupling of an electrical connector of the tip 102 to the electrical connector 209 of the fluid-ejection device 100 at the same time that the tip 102 is placed on the pneumatic fitting 220 of the fluid-ejection device 100.

Additionally, the part 314 of the enclosure 104 of the fluid-ejection device 100 includes a pair of anti-rotation ribs 322A and 322B, collectively referred to as the ribs 322. The anti-rotation ribs 322 are at least substantially parallel to the alignment ribs 320. The anti-rotation ribs 322 prevent rotation of the tip 102 on the pneumatic fitting 220 while the tip 102 is placed on and/or is being placed on the pneumatic fitting 220. This is because when the tip 102 is placed on the pneumatic fitting 220, the portion of the tip 102 containing an electrical connector that mates with the electrical connector 209 of the fluid-ejection device 100 is passively secured into place by the ribs 322, preventing the tip 102 from rotating.

The anti-rotation ribs 322 of the part 314 of the enclosure 104 of the fluid-ejection device 100 also ensure secure electrical coupling between an electrical connector of the tip 102 to the electrical connector 209 of the fluid-ejection device 100. This is because when the tip 102 is placed on the pneumatic fitting 220, the portion of the tip containing an electrical connector mates with the electrical connector 209 of the fluid-ejection device 100 is located at least substantially parallel to the alignment ribs 320, as at least partially ensured by the beveled edge 340. As such, the electrical connector of the tip 102 is at least substantially parallel to the electrical connector 209, ensuring that all electrical contacts of the former make proper contact with all corresponding electrical contacts of the latter. If the connector of the tip 102 were not at least substantially parallel to the connector 209, then one or more of the contacts of the former may not make proper contact with corresponding contacts of the latter.

FIGS. 4A, 4B, 4C, and 4D depict an ejection mechanism of the fluid-ejection device 100 and how the ejection mechanism is actuated to cause removal of the tip 102 from the fluid-ejection device 100, according to an embodiment of the invention. The ejection mechanism particularly includes the ejection control 110, an ejection tab 402, and an ejection spring 406. The ejection mechanism can further include other components, in addition to and/or in lieu of those depicted in FIGS. 4A, 4B, 4C, and 4D.

Figure 4B:
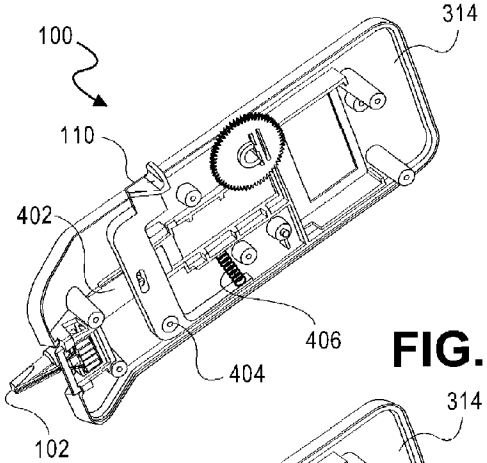
FIGS. 4A, 4B, 4C, and 4D are diagrams depicting an ejection mechanism of a fluid-ejection device and how the ejection mechanism is actuated to cause removal of the tip from the fluid-ejection device, according to an embodiment of the invention.
Figure 4D:
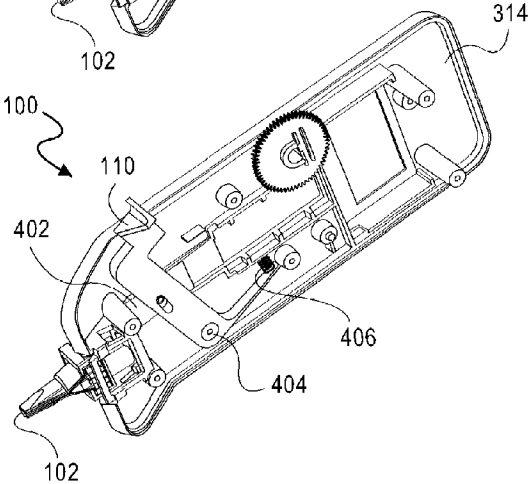
Figure 4A:
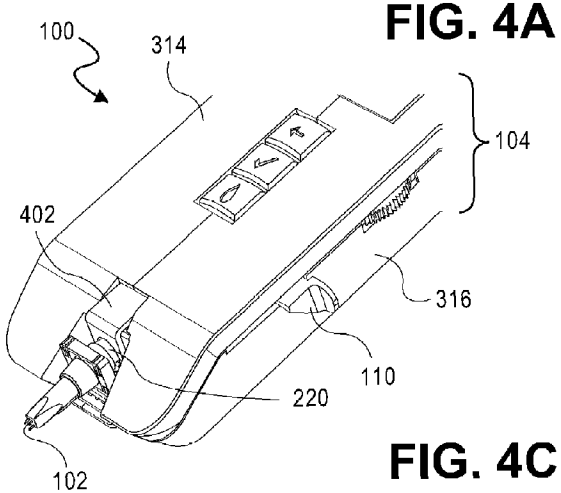

In FIGS. 4A and 4B, the ejection control 110 has not been actuated by the user, such that the tip 102 remains securely placed on the pneumatic fitting 220 of the fluid-ejection device 100. The ejection control 110 is affixed to the part 314 of the enclosure 104 of the fluid-ejection device 100 at an axis of rotation 404, and extends through the part 314 of the enclosure 104. The ejection spring 406 is positioned between the part 314 of the enclosure 104 and the ejection control 110, and is an uncompressed position when the ejection control 110 has not been actuated by the user.

The ejection tab 402 is connected to the ejection control 110, and is able to move in a direction parallel to the length of the fluid-ejection device 100. Near where the ejection tab 402 extends through the enclosure 104, it is bent at a substantially ninety-degree angle and straddles the pneumatic fitting 220. Movement of the ejection tab 402 further is in a direction parallel to a centerline of the pneumatic fitting 220.

Figure 4C:
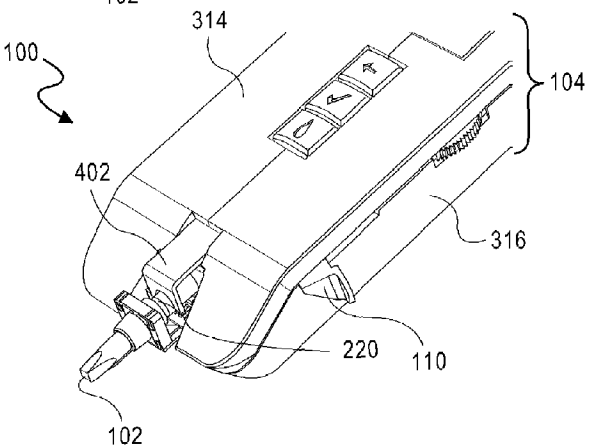

In FIGS. 4C and 4D, the ejection control 110 has been actuated by the user, where specifically the user pushes down on the ejection control 110, such that the tip 102 is ejected from its prior secure placement on the pneumatic fitting 220 of the fluid-ejection device 100. In particular, the ejection control 110 rotates at its axis of rotation 404, causing the ejection tab 402 to be pushed downwards so that it is further extended through the enclosure 104. Because the ejection tab 402 straddles the pneumatic fitting 220, and because the tip 102 is placed on the pneumatic fitting 220, this further extension of the ejection tab 402 causes the tab 402 to push the tip 102 completely off the pneumatic fitting 220, although the tip 102 is shown in FIGS. 4C and 4D as still partially remaining on the pneumatic fitting 220 for illustrative clarity. This removal of the tip 102 from the pneumatic fitting 220 also electrically decouples the electrical connector of the tip 102 from the electrical connector 209 of the fluid-ejection device 100, the latter which is not specifically shown in FIGS. 4C and 4D for illustrative clarity.

Rotation of the ejection control 110 at its axis of rotation 404 upon user actuation of the ejection control 110 in FIGS. 4C and 4D also compresses the ejection spring 406. The ejection spring 406 serves to return the ejection control 110 to its former position once the user no longer is pushing the ejection control 110 downwards. Thus, upon removal of user actuation of the ejection control 110, the force built up by the ejection spring 406 being compressed in FIGS. 4C and 4D causes the spring to push the ejection control 110 back to its original position as depicted in FIGS. 4A and 4B.

Tip in Detail

Figure 5B:
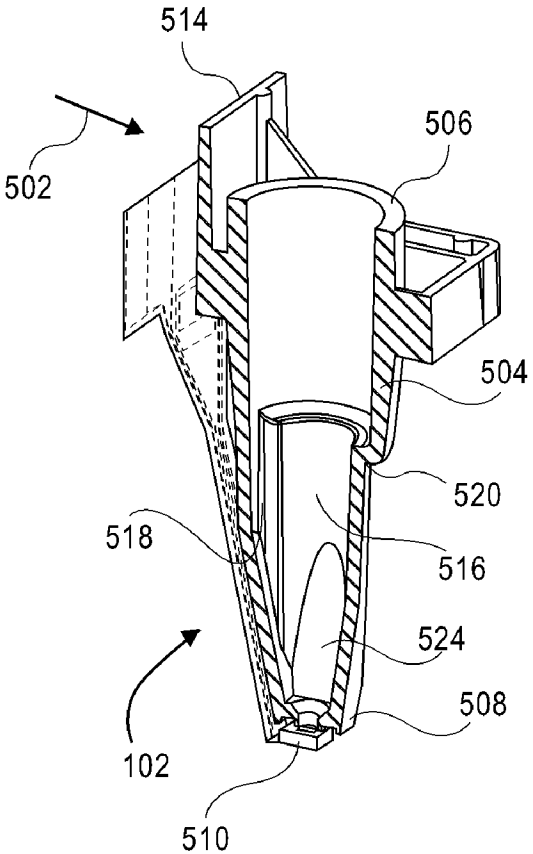
FIGS. 5A and 5B are diagrams of a tip for placement on a fluid-ejection device, according to an embodiment of the invention.
Figure 5A:
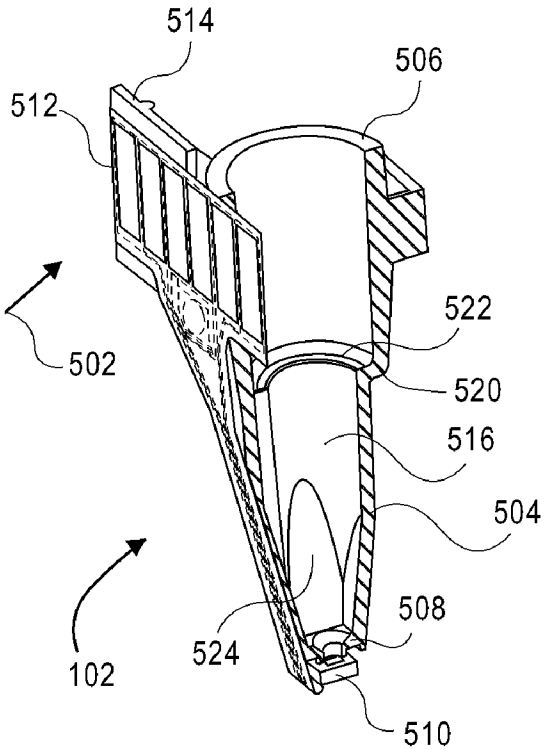

FIGS. 5A and 5B show partial cutaway views of the tip 102 for placement on the fluid-ejection device 100 in detail, according to an embodiment of the invention. Both FIGS. 5A and 5B are oriented in relation to the arrow 502, which is pointed towards a particular side of the tip 102. The tip 102 includes a substantially hollow body 504 to contain a supply of fluid. The body 504 may be fabricated from plastic or another material, and includes a first end 506 and a second end 508. The body 504 of the tip 104 tapers from the first end 506 to the second end 508. The first end 506 corresponds to the pneumatic fitting 220 of the fluid-ejection device 100. The tip 102 is placed on the fluid-ejection device 100 such that the first end 506 of the tip 102 is placed on the pneumatic fitting 220 of the device 100.

The tip 102 further includes a fluid-ejection mechanism 510 situated or disposed at the second end 508 of the body 504 of the tip 102. The fluid-ejection mechanism 510 may be an inkjet printhead-like fluid-ejection mechanism, for instance, containing a smaller number of individual fluid-ejection nozzles, or orifices, than is typically found on an inkjet printhead. The fluid-ejection mechanism 510 ejects the fluid contained within the body 504 therefrom, outwards from the tip 102, such as via the nozzles or orifices thereof.

The tip 102 also includes an electrical connector 512. The electrical connector 512 is electrically connected to the fluid-ejection mechanism 510 of the tip 102, and corresponds to the electrical connector 209 of the fluid-ejection device 100. Thus, the electrical connector 512 electrically couples to the electrical connector 209, so that the fluid-ejection device 100 is able to control ejection of the fluid contained within the tip 102 by the fluid-ejection mechanism 510.

The electrical connector 512 is mounted on a flat tab 514 of the tip 102 that is at least substantially parallel to a centerline of the body 504. The flat tab 514 in the embodiment of FIGS. 5A and 5B extends beyond the electrical connector 512, but in other embodiments the connector 512 is flush with or extends beyond the tab 514. As such, when the tip 102 is placed on the fluid-ejection device 100, the flat tab 514 makes contact with the fluid-ejection device 100 before the electrical connector 512 does, which can prevent damage to the electrical connector 512. Furthermore, the flat tab 514 functions as an anti-rotation surface of the tip 102 that cooperates with the anti-rotation ribs 322 of the fluid-ejection device 100 to prevent rotation of the tip 102 on the pneumatic fitting 220 of the device 100 while the tip is placed on and/or is being placed on the pneumatic fitting 220. In addition, the flat tab 514 cooperates with the beveled edge 340 of the fluid-ejection device 100 to ensure that the electrical connector 512 is parallel in placement in relation to the electrical connector 209 of the device 100, such that the connectors 512 and 209 are securely electrically coupled to one another.

More specifically, comparing FIGS. 5A and 5B to FIG. 3C, the flat tab 514 of the tip 102 is inserted into the enclosure 104 of the fluid-ejection device 100 such that it is located between the ribs 320 and the anti-rotation ribs 322 of the enclosure 104. The flat tab 514 is secured between the ribs 320 and 322, which prevents the tip 102 from rotating on the pneumatic fitting 220 when the body 504 of the tip 102 is inserted on the pneumatic fitting 220 at the first end 506 of the body 504. Alignment of the flat tab 514 between the ribs 320 and 322 also ensures that the electrical connector 512 of the tip 102 makes proper electrical coupling to the electrical connector 209 of the fluid-ejection device 100. That is, all the electrical contacts of the former make electrical connection to all the electrical contacts of the latter, due to this alignment.

The tapering of the body 504 of the tip 102 from the first end 506 to the second end 508 allows for the first end 506 of the body 504 of a first tip to receive the second end 508 of the body 504 of a second tip. As such, two tips can be nested together. This allows for fluid to be ejected, or moved, from a first tip placed on the fluid-ejection device 100 into a second tip in which the first tip has been inserted or nested.

The body 504 of the tip 102 includes a primary channel 516 between the first end 506 and the second end 508. The primary channel 516 is the primary manner by which fluid introduced at the first end 506 of the body 504 is delivered to the fluid-ejection mechanism 510 at the second end 506 of the body 504, such as by gravity. The body 504 also includes a secondary channel 518, called out only in FIG. 5B, between the first end 506 and the second end 508. The secondary channel 518 may be a secondary manner by which fluid introduced at the first end 506 is delivered to the fluid-ejection mechanism 510 at the second end 506. The secondary channel 518 is smaller than the primary channel 516, and is located to a side of the primary channel 516.

Furthermore, the secondary channel 518 within the body 504 of the tip 102 promotes the escaping of trapped gas, such as air, during delivery of the fluid to the fluid-ejection mechanism 510 at the second end 508 of the body 504. That is, while the fluid is moving within the body 504 from the first end 506 to the fluid-ejection mechanism 510 at the second end 508, air or other gas can become trapped, which can result in undesired bubbles within the fluid. The presence of the secondary channel 518 substantially alleviates this trapped gas, by providing a route by which such undesired bubbles can escape. Trapped gas is undesirable because it can result in a pocket of gas at the fluid-ejection mechanism 510, such that the fluid-ejection mechanism 510 can be starved of fluid to eject therefrom, even though there is fluid contained within the body 504 itself.

The body 504 of the tip 102 includes a substantially abrupt horizontal external edge 520 between the first end 506 and the second end 508 of the body 504. The edge 520 can act as a vertical stop, or z-stop. For example, when one tip is inserted into another tip, the former tip is prevented from going any further into the latter tip by virtue of the vertical stop of the edge 520.

The body 504 of the tip 102 also includes a substantially abrupt horizontal internal edge 522 between the first end 506 and the second end 508 of the body 504. The edge 522 reduces wicking of the fluid in a direction from the second end 508 to the first end 506 of the body 504. That is, upon introduction of fluid at the first end 506 and upon movement or delivery of this fluid to the fluid-ejection mechanism 510 at the second end 508, the fluid may have a natural disposition to wick back up towards the first end 506, such that it adheres to the interior sides of the body 504. Such wicking can decrease the usable volume of fluid within the body 504 that can be ejected from the fluid-ejection mechanism 510, and can also result in the fluid coming into contact with the pneumatic fitting 220. The edge 522, being abrupt, serves to limit if not eliminate such undesirable movement further upwards within the body 504 towards the body 504 past the point of the edge 522.

The body 504 of the tip 102 has an at least partially round external surface towards the first end 506. However, the fluid-ejection mechanism 510 can be a rectangularly shaped component. Therefore, the body 504 transitions from an at least partially round external surface towards the first end 506 to a number of narrowing planar surfaces at the second end 508 at which the fluid-ejection mechanism 510 is mounted. One such narrowing planar surface 524 is called in out in FIGS. 5A and 5B for example purposes. These narrowing planar surfaces correspond to the edges of the fluid-ejection mechanism 510.

Figure 6A:
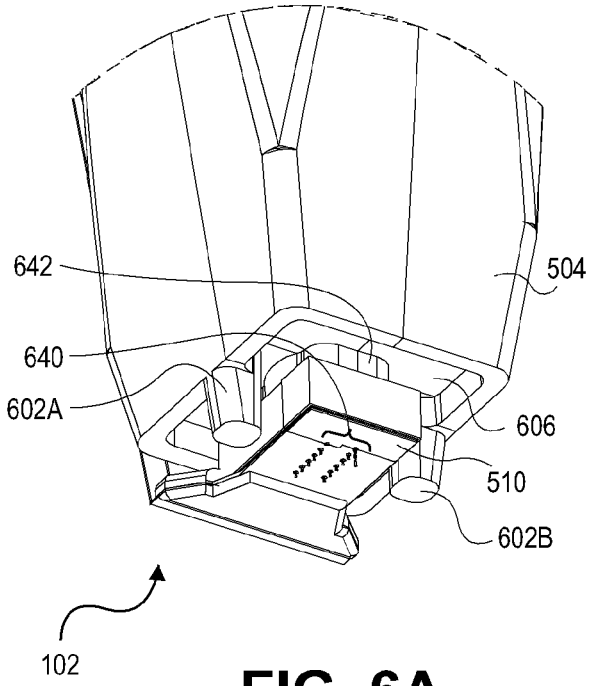
FIGS. 6A and 6B are diagrams depicting a fluid-ejection mechanism of a tip mounted to a body of the tip, according to an embodiment of the invention.
Figure 6B:
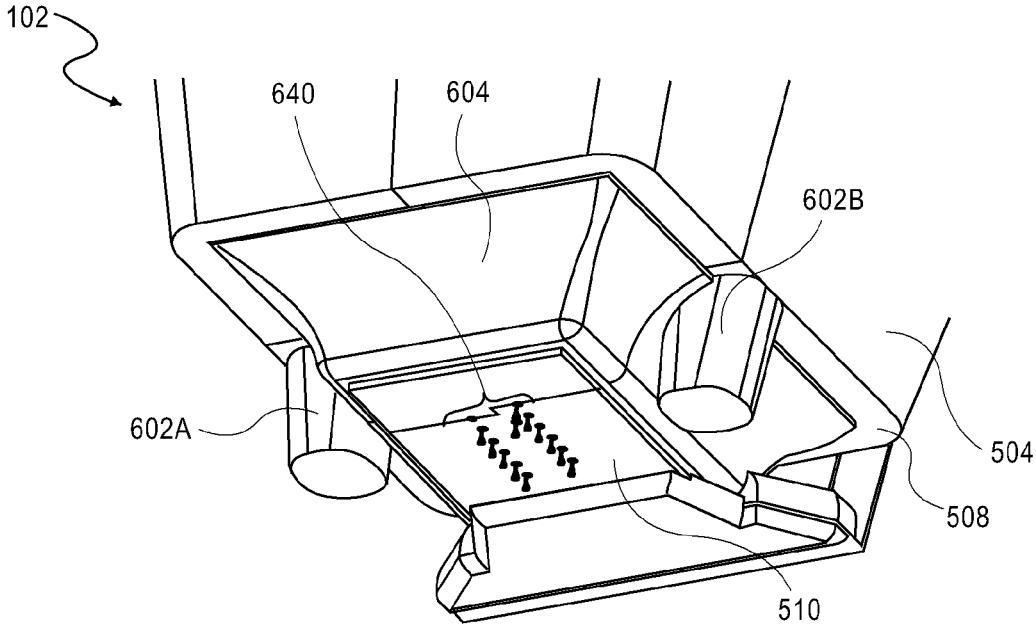

FIGS. 6A and 6B show how the fluid-ejection mechanism 510 of the tip 102 is mounted at the second end 508 of the body 504 of the tip 102, according to an embodiment of the invention. A pair of posts 602A and 602B, collectively referred to as the posts 602, extend from the body 504 at the second end 508 thereof. A mounting platform 642 at the second end 508 of the body 504 is located between the posts 602, around which there is a partially recessed area 606 defined at the end 508 of the body 504, as is particularly shown in FIG. 6A. The fluid-ejection mechanism 510 is placed on the mounting platform 642.

Thereafter, as is particularly shown in FIG. 6B, adhesive 604 is added to the partially recessed area 606 around the mounting platform 642, and can partially extend onto the sides of the fluid-ejection mechanism 510 to secure the mechanism 510 to the mounting platform 642. The partially recessed area 606 contains any excess adhesive, and thus serves as a moat to prevent any excess adhesive from spilling onto the fluid-ejection mechanism 510 or other parts of the tip 102. Also depicted in both FIGS. 6A and 6B are the actual nozzles 640 of the fluid-ejection mechanism 510 of the tip 102, from which fluid is ejected. The nozzles 640 may further be referred to as orifices.

It is noted that different types of tips may have different numbers and different sizes of nozzles within their fluid-ejection mechanisms and from which fluid is actually ejected. Different types of tips thus may be employed to eject fluids of different volumes. Furthermore, different types of tips may be employed based on the type of fluid that is to be ejected. As just one example, more viscous fluids may be ejected from tips having larger nozzles, whereas less viscous fluids may be ejected from tips having smaller nozzles. Therefore, for a given application in which a particular type of fluid is to be ejected at a given volume, different types of tips may be investigated to determine the appropriate tip and to determine the appropriate parameters for controlling this tip in the desired manner.

Furthermore, the materials from which different tips and/or their fluid-ejection mechanism are fabricated may be the same (i.e., common), while still allowing the tips to eject fluid at a wide range of different volumes, such as between 1-500 picoliters. This is advantageous as compared to the prior art, which typically employs different types of materials for fluid-ejection mechanisms, depending on the volume of the fluid to be ejected. Therefore, where it is not known a priori which type of tip having which size and what number of nozzles is most appropriate for ejecting a given type of fluid at a desired volume, embodiments of the invention conveniently provide for this fluid just having to be tested, certified, or approved in relation to one set of materials. Because the different types of tips may be manufactured from this same set of materials, once approval of the given fluid as to this set of materials has been established, the different types of tips can thereafter be investigated in relation to this fluid to determine which tip under what parameters yields the desired ejection of this fluid.

By comparison, within the prior art, where it is not known a priori what type of fluid-ejection mechanism having which size and what number of nozzles is most appropriate for ejecting a given type of fluid at a desired volume, the fluid may have to be tested, certified, or approved in relation to a much larger number of sets of materials. This is because, within the prior art, different fluid-ejection mechanism may be manufactured from different sets of materials. Therefore, investigation in relation to a given fluid as to which fluid-ejection mechanism under what conditions most appropriately yields the desired ejection of this fluid is more difficult and less convenient, because the fluid may have to first be tested, certified, or approved in relation to a relatively large number of different sets of materials.

Therefore, an advantage of embodiments of the invention is that within a given fluid-ejection architecture, a wide variety of different tips and/or fluid-ejection mechanisms thereof, having a wide variety of different numbers and different sizes of nozzles from and through which fluid is actually ejected, is accommodated. Once a given type of fluid is tested, certified, or approved for use within this fluid-ejection architecture, a user can eject the fluid using this wide variety of different tips and/or fluid-ejection mechanisms thereof. The user thus does not have to concern him or herself with locating and testing different fluid-ejection architectures, as in the prior art.

Using Fluid-Ejection Device and Tip to Eject Fluid

Figure 7:
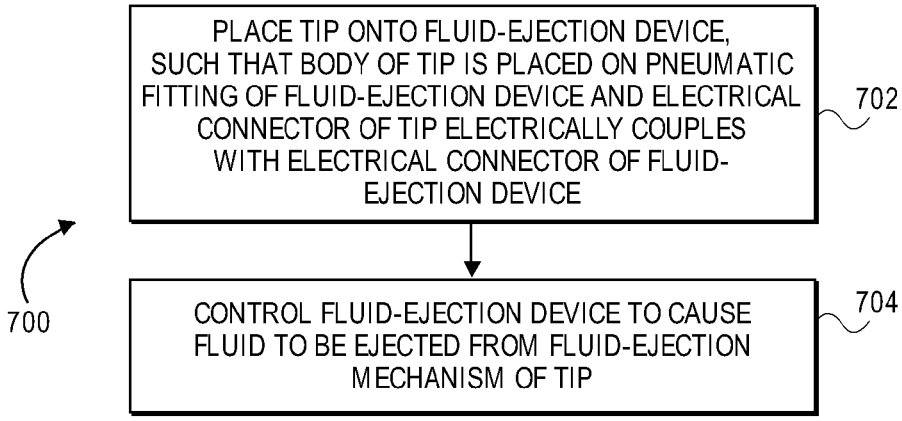
FIG. 7 is a flowchart of a method for using a fluid-ejection device in accordance with a tip containing a supply of fluid, according to an embodiment of the invention.

Thus far in the detailed description the fluid-ejection device 100 and the tip 102 have been described in detail. FIG. 7 shows a method 700 for using the fluid-ejection device 100 in accordance with the tip 102 containing a supply of fluid, according to an embodiment of the invention. The tip 102 is placed on the fluid-ejection device 100 (702). More specifically, the body 504 of the tip 102 is placed on the pneumatic fitting 220 of the fluid-ejection device 100, at the first end 506 of the body 504 of the tip 102. The electrical connector 512 of the tip 102 electrically couples with the electrical connector 209 of the fluid-ejection device 100 as a result of the placement of the tip 102 on the device 100. The tip 102 is presumed to have been initially filled with a supply of a desired fluid.

Thereafter, the fluid-ejection device 100 is controlled to cause the fluid contained within the tip 102 to be ejected from the fluid-ejection mechanism 510 of the tip 102 (704). For instance, in one embodiment, the user may appropriately actuate the controls 106 to cause the controller components 208 of the fluid-ejection device 100 to communicate with the fluid-ejection mechanism 510 of the tip 102 to cause the mechanism 510 to eject one or more drops of the fluid at a desired location over which the tip 102 is positioned. In another embodiment, a computing or another device communicatively coupled to the fluid-ejection device 100, via the interfaces 204, results in the controller components 208 of the device 100 communicating with the fluid-ejection mechanism 510 of the tip 102 to cause the mechanism 510 to eject one or more drops of the fluid at a desired location over which the tip 102 is positioned.

It is noted that the method 700 may be repeated for a variety of different types of tips that are all fabricated from a common set of materials to determine which of these tips is most appropriate for ejection of the fluid at a desired volume. Thus, the fluid in question just has to be certified against this common set of materials. This is advantageous, in that it renders investigation of different nozzle numbers and sizes, as may be present on the different tips, to locate the optimal tip for ejection of the fluid in question at the desired volume, more efficient. That is, unlike the prior art, the fluid does not have to certified against even a small number of different material sets in one embodiment, since all the different types of tips are fabricated from the same material set.

Nesting of Tips for Delivery of Fluid from One Tip to Another Tip for Mixing

Figure 8:
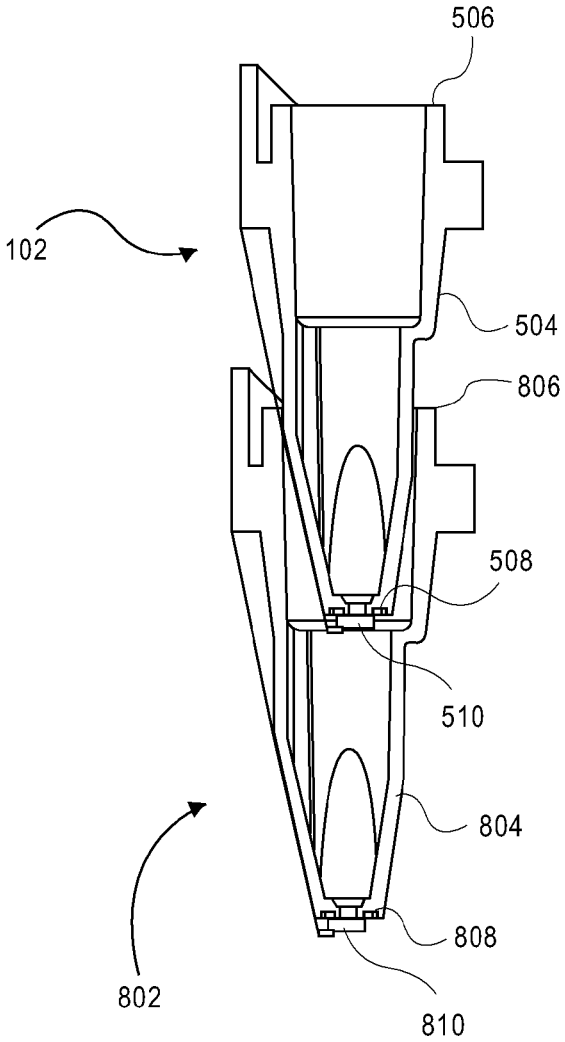
FIG. 8 is a diagram of one tip being inserted into another tip in a nesting manner so that fluid can be ejected from the former tip to the latter tip, according to an embodiment of the invention.

FIG. 8 shows how the tip 102 can be nested into another tip 802 for delivery of fluid from the tip 102 into the tip 802, according to an embodiment of the invention. The tip 102 is placed on the fluid-ejection device 100, which is not depicted in FIG. 8 for illustrative clarity and convenience. The tip 802 has a body 804 having a first end 806 and a second end 808, the latter at which a fluid-ejection mechanism 810 is disposed. The tip 802 is in general another copy of the tip 102 that has been depicted in other figures and that has already been described in detail. Thus, the tip 802 can include other parts and components besides those particularly called out in FIG. 8.

The tip 102 is inserted into the tip 802 such that the tip 102 is nested within the tip 802. More specifically, the body 504 of the tip 102 is inserted in and nested within the body 804 of the tip 802. The second end 508 of the body 504 of the tip 102 is inserted at the first end 806 of the body 804 of the tip 802. Once the tip 102 has been nested within the tip 802, the fluid-ejection device 100 can be appropriately controlled so that the fluid-ejection mechanism 510 of the tip 102 ejects fluid contained within the tip 102 into the body 804 of the tip 802 as desired. The fluid-ejection device 100, with the tip 102 placed thereon, may then be removed from the tip 802, such that the tip 102 is no longer nested within the tip 802. Thereafter, the tip 102 may be removed from the fluid-ejection device 100 itself. A third tip may then be placed on the fluid-ejection device 100 and inserted into the tip 802 for ejection of a different type of fluid into the tip 802. This process can be repeated for any of a number of different tips containing any number of different types of fluid.

The tips can in one embodiment eject fluid drops having volumes between 1-500 picoliters. It has been observed that after the tip 102 has ejected fluid into the tip 802, the ejection of another type of fluid from a third tip into the tip 802 results in the fluids ejected from the tip 102 and the third tip into the tip 802 mixing substantially readily, spontaneously, and/or instantaneously within the tip 802. That is, no further action needs to be performed in relation to the two different fluids ejected into the tip 802, such as agitation, swirling, as well as other types of actions, to cause the fluids to uniformly mix within the tip 802.

This is because the volumes of the fluids ejected from the tip 102 and the third tip into the tip 802 are so small. If the volumes were larger, then an additional action may have to be performed to result in uniform and complete mixing. In general, any number of different tips containing any number of different types of fluid can be inserted into the tip 802 for ejection of fluids into the tip 802, and the resulting fluids contained within the tip 802 substantially instantaneously, spontaneously, and/or readily mixed uniformly and completely within the tip 802 without having to perform any further actions besides fluid ejection.

Figure 9:
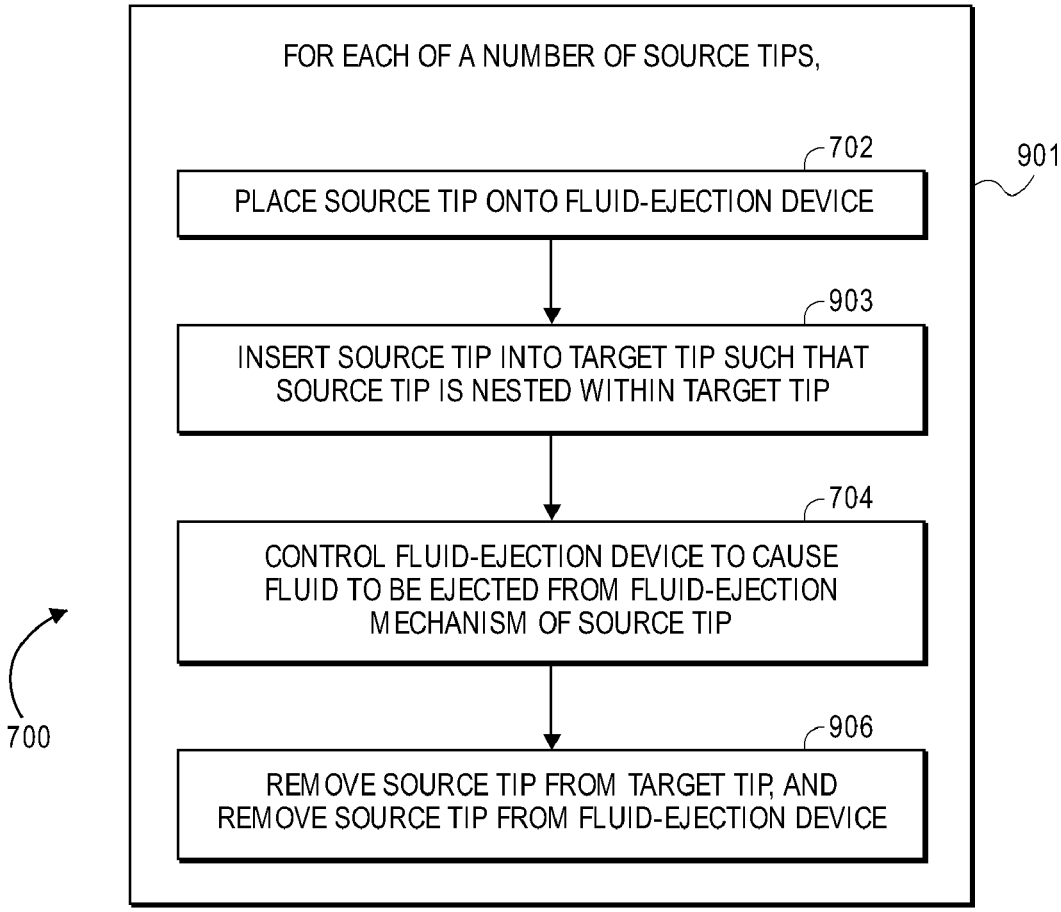
FIG. 9 is a flowchart of a method for using a number of different source tips to eject fluids into the same target tip to readily and completely mix the fluids ejected from the different source tips within the target tip, according to an embodiment of the invention.

FIG. 9 shows the method 700 of FIG. 7 as extended to illustrate the process of ejecting different types of fluids from different source tips into the same target tip 802, according to an embodiment of the invention. In the method 700 of FIG. 9, the tip 102 is one of a number of different source tips. It is presumed that each of these source tips have already been filled with a desired type of fluid. For each source tip, the following is therefore performed (901).

The source tip is placed on the fluid-ejection device 100 (702), as has been described in detail in relation to FIG. 7. The source tip is then inserted into the target tip 802 (903), such that, for instance, the source tip is nested within the target tip 802, as has been described in relation to FIG. 8. The fluid-ejection device 100 is controlled to cause the fluid contained within the source tip to be ejected from the fluid-ejection mechanism of the source tip into the target tip 802 (704), as has been described in detail in relation to FIG. 7. Thereafter, the source tip is removed from the target tip 802, as well as from the fluid-ejection device 100 (906).

The different fluids that are ejected into the target tip 802 are substantially readily and completely mixed together upon ejection from the source tips into the target tip 802. No further action, such as agitation, has to be performed in relation to the target tip 802 to cause such mixing, due to the fluids being ejected from the source tips in drops having volumes measurable in picoliters. The method 700 of FIG. 7 that has been described can then be performed in relation to the target tip 802, such that the tip 802 is placed on the fluid-ejection device 100, and the fluid-ejection device 100 controlled to eject the mixed fluids from the target tip 802 at a desired location.

Filling Tip with Fluid

Figure 10:
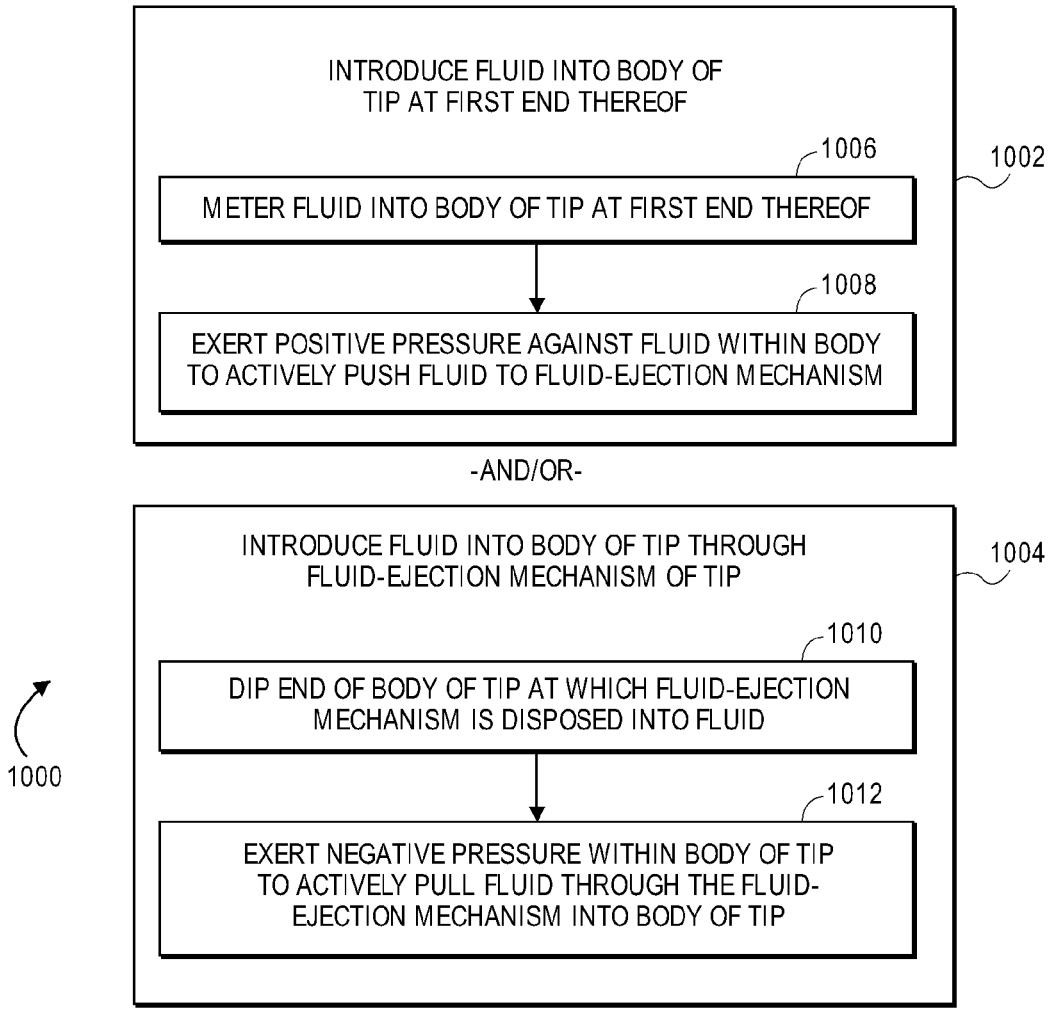
FIG. 10 is a flowchart of a method for filling with fluid a tip for placement on a fluid-ejection device, according to an embodiment of the invention.

Before the method 700 of use of FIGS. 7 and 9 can be performed, the tips that are to be placed on the fluid-ejection device 100 have to be filled with fluid. FIG. 10 shows a method 1000 for filling the tip 102 with fluid, according to an embodiment of the invention. The method 1000 particularly shows two different ways for filling the tip 102 with fluid, either or both of which may be used. First, fluid may be introduced into the body 504 of the tip 102 at the end 506 thereof (1002). Second, fluid may be introduced into the body 504 of the tip 102 through the fluid-ejection mechanism 510 at the end 508 of the body 504 (1004). Both of these approaches are now described in more detail.

Filling the tip 102 with fluid by introducing the fluid into the body 504 of the tip 102 at the end 506 thereof (1002) may be achieved by performing part 1006, or by performing parts 1006 and 1008. First, the fluid is metered into the body 504 of the tip 102 at the end 506 thereof (1006). If this is all that is performed to fill the tip 102, then the fluid will passively flow through the interior of the body 504 until it reaches the fluid-ejection mechanism 510 at the end 508 of the body 504. Such fluid flow is passive in that it is achieved without external forces being applied to the fluid other than gravity, wicking action, and so on.

Second, positive pressure may also be exerted against the fluid within the body 504 of the tip 102 to actively push the fluid through the interior of the body 504 until it reaches the fluid-ejection mechanism 510 at the end 508 of the body 504 (1008). Such fluid flow is active in that it is achieved with an external force being applied to the fluid to create the positive pressure. For example, placement of the tip 102 on the fluid-ejection device 100 can create momentary positive pressure that is exerted against the fluid to push it to the fluid-ejection mechanism 510. As another example, once the tip 102 has been placed on the fluid-ejection device 100, the pump 222 may be employed to push air (or another gas) through the channel 216 to the tip 102 via the pneumatic fitting 220, where this air (or other gas) creates the positive pressure exerted against the fluid to push it to the fluid-ejection mechanism 510.

Figure 11B:
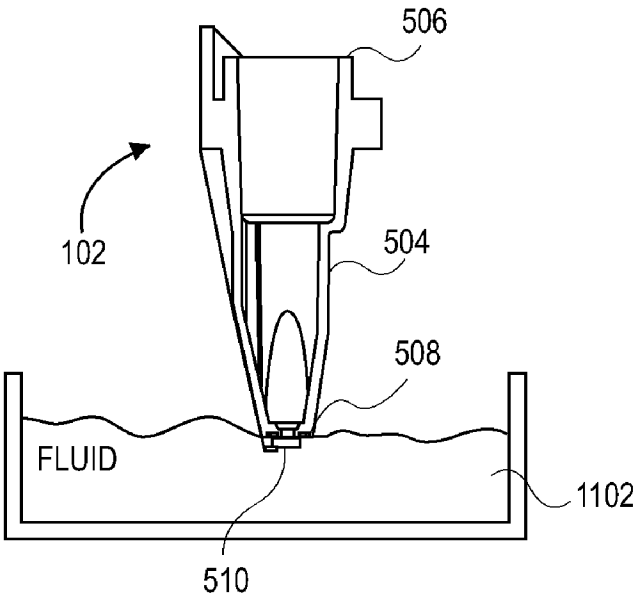
FIGS. 11A and 11B are diagrams depicting exemplary filling of a tip with fluid, according to varying embodiments of the invention.
Figure 11A:
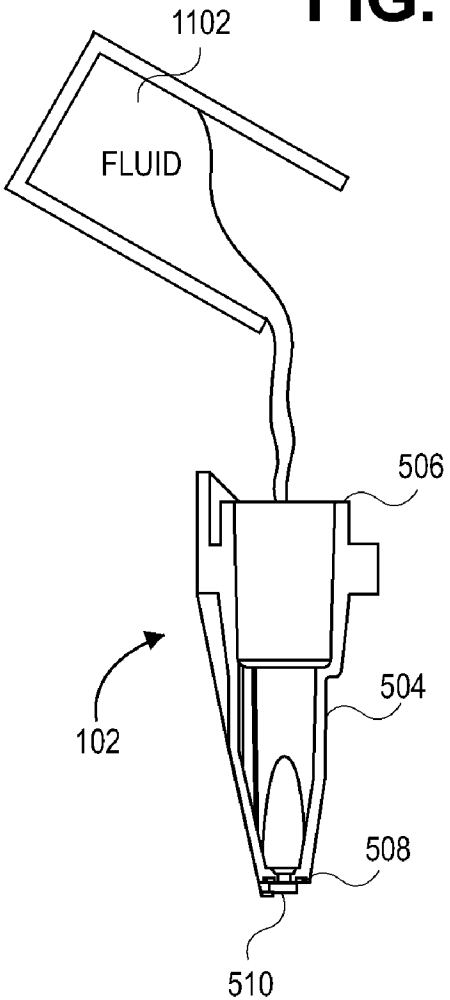

FIG. 11A shows illustrative performance of part 1002 of the method 1000 of FIG. 10, according to an embodiment of the invention. Fluid 1102 is poured into the body 504 of the tip 102 at the end 506 thereof. Actively or passively, the fluid 1102 moves within the interior of the body 504 until it reaches the fluid-ejection mechanism 510 at the end 508 of the body 504 of the tip 102. As such, the fluid-ejection mechanism 510 is wetted with the fluid 1102 introduced at the other end 506 of the body 504 of the tip 102.

Referring back to FIG. 10, filling the tip 102 with fluid by introducing the fluid into the body 504 of the tip 102 through the fluid-ejection mechanism 510 at the end 508 of the body 504 (1004) may be achieved by performing part 1010, or by performing parts 1010 and 1012. First, the end 508 of the body 504 of the tip 102, at which the fluid-ejection mechanism 510 is disposed, may be dipped into fluid (1010). If this is all that is performed to fill the tip 102, then the fluid will be passively drawn into the body 504 of the tip 102 through the fluid-ejection mechanism 510. Such fluid flow is passive in that it is achieved without external forces being applied to the fluid other than wicking action.

Second, negative pressure may also be exerted within the body 504 of the tip 102 to actively pull fluid through the fluid-ejection mechanism and into the body 504 (1012). Such fluid flow is active in that it is achieved with an external force being applied to create the negative pressure. For example, where the tip 102 has been placed on the fluid-ejection device 100, the pump 222 may be employed to pull air or another gas through the channel 216 from the tip 102 via the pneumatic fitting 220, where this air or gas removal creates the negative pressure within the body 504 to pull the fluid through the fluid-ejection mechanism 510 and into the body 504 of the tip 102.

FIG. 11B shows illustrative performance of part 1010 and/or part 1012 of the method 1000 of FIG. 10, according to an embodiment of the invention. The body 504 of the tip 102 is dipped into the fluid 1102 at the second 508 thereof, at least partially submerging the fluid-ejection mechanism 510 within the fluid 1102. Actively or passive, the fluid 1102 is drawn into the interior of the body 504 through the fluid-ejection mechanism 510 of the tip 102. This approach to filling the tip 102 with the fluid 1102 is a contact-manner approach, in that the body 504 of the tip 102 at the second end 508 makes contact with the fluid 1102. Such a contact-manner approach contrasts with a non-contact-manner approach, which FIG. 11A as has been described depicts in at least some situations and/or embodiments.

Tip Servicing

Figure 12:
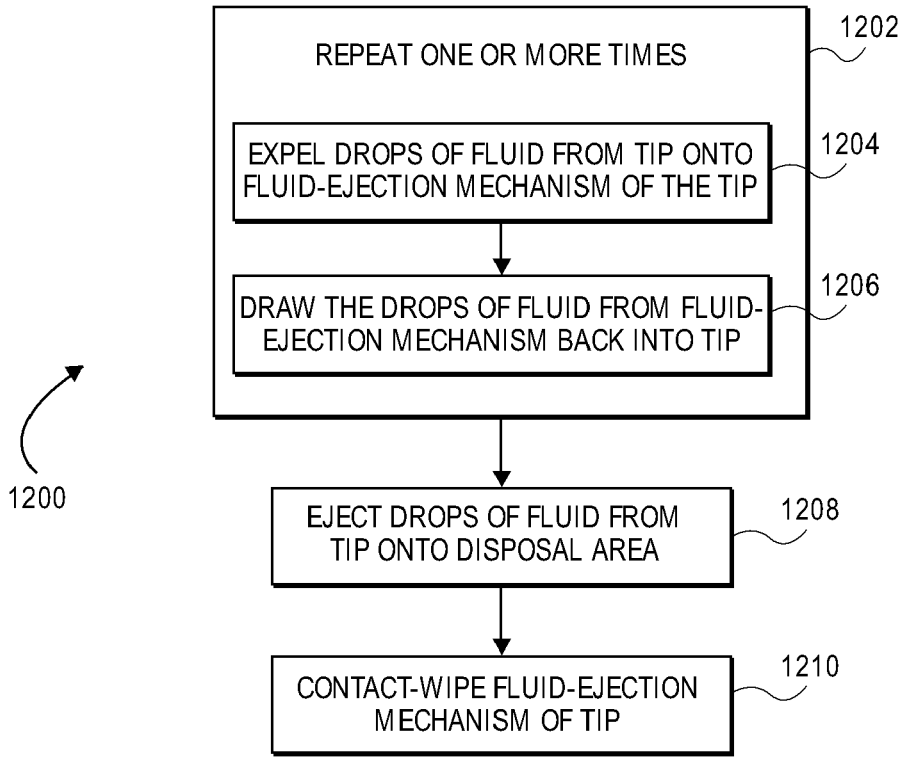
FIG. 12 is a flowchart of a method for servicing a tip, according to an embodiment of the invention.

Before or after the method 700 of use of FIGS. 7 and 9 is performed, the tips that are placed on the fluid-ejection device 100 may have to be at least occasionally serviced, to ensure that no fluid dries on the fluid-ejection mechanisms thereof and clogs the nozzles or orifices of the fluid-ejection mechanisms, for instance. FIG. 12 shows a method 1200 by which the tip 102 may be serviced, according to an embodiment of the invention. First, parts 1204 and 1206 are repeated one or more times (1202).

Thus, one or more drops of fluid are output from the body 504 of the tip 102 onto fluid-ejection mechanism 510 disposed at the end 508 of the body 504 (1204). That is, fluid is not ejected such that it completely exits the tip 102. Rather, fluid is ejected such that one or more drops thereof exit the body 504 but are deposited or remain on the fluid-ejection mechanism 510. For instance, the fluid may be allowed to passively flow from within the body 504 of the tip 102 onto the fluid-ejection mechanism 510 at the end 508 of the body 504, in order to wet the fluid-ejection mechanism 510 with drops of fluid. Such fluid flow is passive in that it is achieved without external forces being applied to the fluid other than gravity, wicking action, and so on.

As another example, positive pressure may be exerted against the fluid within the body 504 of the tip 102 to actively push the fluid to the fluid-ejection mechanism 510 disposed at the end 508 of the body 504, in order to wet the fluid-ejection mechanism 510 with drops of fluid. Such fluid flow is active in that it is achieved with an external force being applied to the fluid to create the positive pressure. For example, placement of the tip 102 on the fluid-ejection device 100 can create momentary positive pressure that is exerted against the fluid to wet the fluid-ejection mechanism 510. As another example, once the tip 102 has been placed on the fluid-ejection device 100, the pump 222 may be employed to push air or another gas through the channel 216 to the tip 102 via the pneumatic fitting 220, where this air or other gas creates the positive pressure exerted against the fluid to wet the fluid-ejection mechanism 510.

Thereafter, the drops of fluid are drawn back from the fluid-ejection mechanism 510 disposed at the end 508 of the body 504 back into the body 504 of the tip 102 (1206). For example, a predetermined length of time may be waited so that at least most of the drops of the fluid passively wick from the fluid-ejection mechanism 510 of the tip 102 back into the body 504 of the tip 102. As before, such fluid flow is passive in that it is achieved without external forces being applied to the fluid other than wicking action.

As another example, negative pressure may be exerted against the fluid within the body 504 of the tip 102 to actively pull the fluid drops from the fluid-ejection mechanism 510 disposed at the end 508 of the body 504 back into the body 504. As before, such fluid flow is active in that it is achieved with an external force being applied to create the negative pressure. For example, where the tip 102 has been placed on the fluid-ejection device 100, the pump 222 may be employed to pull air or another gas through the channel 216 from the tip 102 via the pneumatic fitting 220, where this air or gas removal creates the negative pressure within the body 504 to draw the fluid drops from the fluid-ejection mechanism 510 back into the body 504 of the tip 102.

Figure 13A:
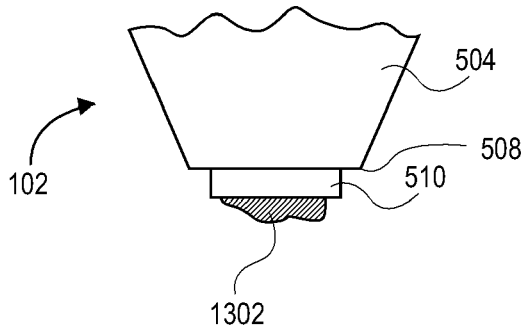
FIGS. 13A, 13B, and 13C are diagrams depicting exemplary tip servicing, according to varying embodiments of the invention.

FIG. 13A shows illustrative performance of part 1204 of the method 1200 of FIG. 12, according to an embodiment of the invention. Fluid drops 1302 have been expelled from within the body 504 of the tip 102 onto the fluid-ejection mechanism 510 disposed at the end 508 of the body 504. Thereafter, at least most of the fluid drops 1302 are drawn back into the body 504 from the fluid-ejection mechanism 510.

Referring back to FIG. 12, the tip-servicing method 1200 can in one embodiment also include ejecting drops of fluid from the body 504 of the tip 102 via the fluid-ejection mechanism 510 disposed at the end 508 of the body 504 onto a disposal area (1208). These fluid drops are desirably those that were repeatedly expelled onto the fluid-ejection mechanism 510 and drawn back into the body 504 of the tip 102 in parts 1204 and 1206. The purpose of such fluid drop disposal can be to ensure that any contaminants that may have been picked up by the repeated expelling and drawing of the fluid drops does not contaminate all the fluid contained within the body 504 of the tip 102. The disposal area may be a container, for instance, or another type of disposal area. The ejection of the fluid drops may be achieved by the fluid-ejection device 100 appropriately controlling the fluid-ejection mechanism 510 to eject the fluid drops.

Figure 13B:
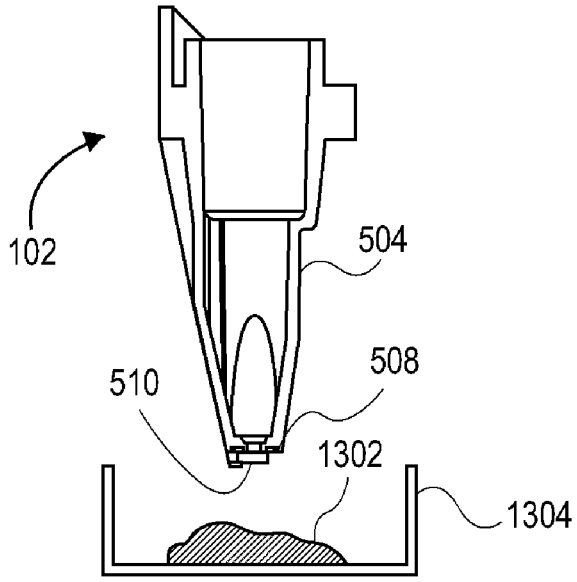

FIG. 13B shows illustrative performance of part 1208 of the method 1200 of FIG. 12, according to an embodiment of the invention. The fluid drops 1302 have been ejected from the body 504 of the tip 102 via the fluid-ejection mechanism 510 disposed at the end 508 of the body 504, onto a disposal area 1304. Not shown in FIG. 13B is that the tip 102 can be and is likely placed on the fluid-ejection device 100, which controls the fluid-ejection mechanism 510 to eject the fluid drops.

Referring back to FIG. 12, the tip-servicing method 1200 can in one embodiment further include contact-wiping the fluid-ejection mechanism 510 disposed at the end 508 of the body 504 of the tip 102 (1210). Specifically, the tip 102, either when it is on the fluid-ejection device 100 or when it is not on the device 100, may be manually moved back and forth over a cleaning medium while the fluid-ejection mechanism 510 is in contact with the medium. The purpose of this contact-wiping may be to clean the fluid-ejection mechanism 510 of the tip 102.

Figure 13C:
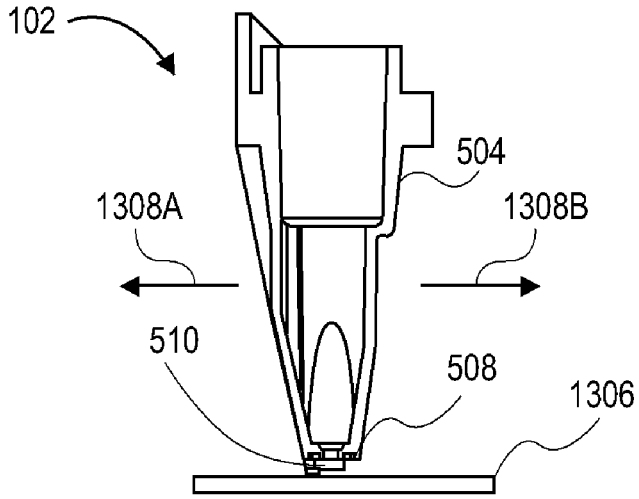

FIG. 13C shows illustrative performance of part 1210 of the method 1200 of FIG. 12, according to an embodiment of the invention. The fluid-ejection mechanism 510 disposed at the end 508 of the body 504 of the tip 102 is in contact with a cleaning medium 1306. The cleaning medium 1306 may be a rubber wiper, a continuously fed strip such that a sterile portion is in continuous contact with the mechanism 510, or another type of cleaning medium. The cleaning medium 1306 may further be a wetted sponge, a wetted cloth, or a clean-room wiping material known under the trade name TEX-WIPE®. The tip 102 may be moved back and forth, as indicated by the arrows 1308A and 1308B, collectively referred to as the arrows 1308, so that the fluid-ejection mechanism 510 is moved back and forth on the cleaning medium 1306.

Tip Identification, and Tip and Fluid-Ejection Device Validation

As has been described above, different types of tips, containing different types of fluids, may be placed on the fluid-ejection device 100 for ejection of fluids from these tips. In order for the fluid-ejection device 100 to properly cause the fluid-ejection mechanism 510 of the tip 102 to eject fluid therefrom, it may have to know the type of the fluid-ejection mechanism 510, and thus the type of the tip 102 placed on the device 100, and/or the type of fluid contained within the tip 102. In one embodiment, the fluid-ejection mechanism 510 of the tip 102 contains an identification string, made up of one or more binary zeros and one or more binary ones, that uniquely identifies the type of the tip 102 and/or the type of the fluid contained within the tip 102.

For instance, the identification string may be implemented as a number of resistors fabricated within the fluid-ejection mechanism 510 of the tip 102. Each resistor has one of two possible different resistances, where one such resistance corresponds to a binary zero, and the other such resistance corresponds to a binary one. Upon electrical coupling of the electrical connector 512 of the tip 102 with the electrical connector 209 of the fluid-ejection device 100, the device 100 reads these resistances to assemble the identification string of the tip 102. With this information, the fluid-ejection device 100 can properly control the fluid-ejection mechanism 510 of the tip 102, via the controllers 208, for ejection of fluid from the mechanism 510.

Furthermore, the fluid-ejection device 100 and the tip 102 may be desirably validated prior to use. Such validation may occur immediately after manufacture of the fluid-ejection device 100 and/or the tip 102, while the tip 102 in particular has no fluid therein and thus is validated "dry." This validation may ensure that there are no leaks or blockages within the fluid-ejection device 100 and the tip 102, and that the tip 102 properly seals with the device 100. Validation may further or alternatively occur by the end user of the fluid-ejection device 100 and the tip 102, while the tip 102 in particular contains fluid and thus is validated "wet." This validation may ensure that the tip 102 properly seals with the fluid-ejection device 100, such that there are no leaks within the system including the device 100 and the tip 102.

Figure 14:
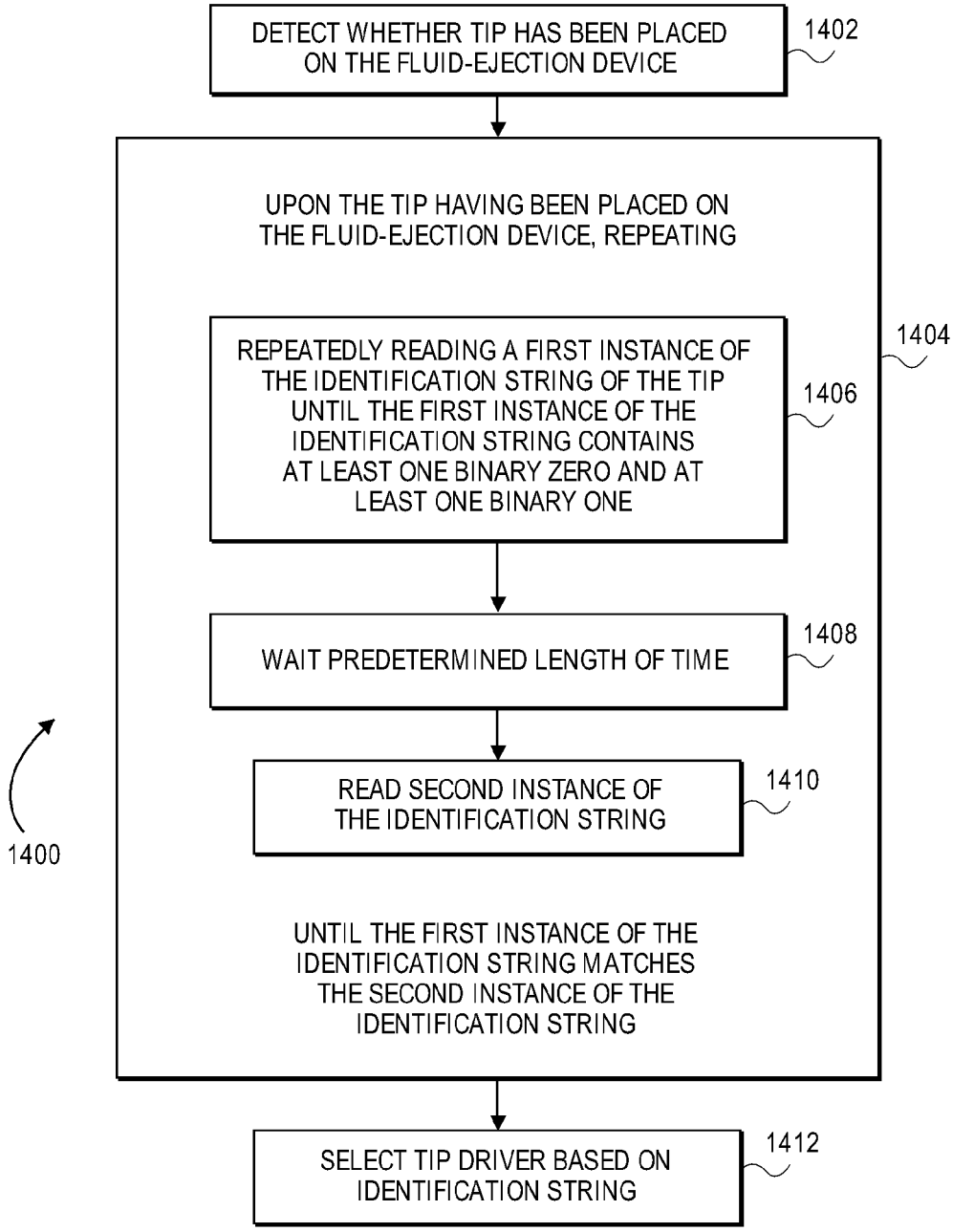
FIG. 14 is a flowchart of a method for identifying a tip that has been placed on a fluid-ejection device, according to an embodiment of the invention.

FIG. 14 shows a method 1400 for identifying the tip 102, according to an embodiment of the invention. At least some parts of the method 1400 may be performed by the fluid-ejection device 100. The fluid-ejection device 100 first detects whether the tip 102 has been placed thereon (1402). More particularly, the fluid-ejection device 100 detects whether the electrical connector 209 has electrically coupled with the electrical connector 512 of the tip 102.

For example, the fluid-ejection device 100 may detect whether there is an open circuit over two or more of the electrical contacts of its electrical connector 209, or whether there is a closed circuit over these electrical contacts. The former condition corresponds to the corresponding electrical contacts of the electrical connector 512 of the tip 102 not electrically coupling with the electrical contacts in question of the electrical connector 209 of the fluid-ejection device 100. That is, because the electrical contacts of the electrical connector 209 are not connected to corresponding electrical contacts of the electrical connector 512 of the tip 102, the resulting open circuit can be used as the basis upon which to conclude that the tip 102 has not yet been placed on the fluid-ejection device 100.

By comparison, a closed circuit corresponds to the corresponding electrical contacts of the electrical connector 512 of the tip 102 electrically coupling with the electrical contacts in question of the electrical connector 209 of the fluid-ejection device 100. A closed circuit results because electricity can flow from the fluid-ejection device 100, via one of the electrical contacts of the electrical connector 209, to the tip 102, via one of the electrical contacts of the electrical connector 512, and back to the fluid-ejection device 100. Therefore, the closed circuit can be used as the basis upon which to conclude that the tip 102 has been placed on the fluid-ejection device 100.

Upon detecting that the tip 102 has been placed on the fluid-ejection device 100, the following is performed until a first read instance of the identification string of the tip 102 matches a second read instance of this identification string (1404). In particular, the fluid-ejection device 100 first repeatedly reads a first instance of the identification string of the tip 102 until this instance of the identification string contains at least one binary zero and at least one binary one (1406). It is known a priori that a valid identification string is not all binary zeros or all binary ones in one embodiment. The fluid-ejection device 100 therefore repeatedly reads the identification string until the string as read does not contain all binary zeros or all binary ones. Reading all binary zeros or all binary ones can indicate that the electrical connector 209 of the fluid-ejection device 100 has not yet made complete electrical contact with the electrical connector 512 of the tip 102, despite the successful detection of the tip 102 being placed on the device 100, such that repeated reading may be performed in part 1406.

Next, a predetermined length of time is waited (1408), to ensure that any electrical signals being transmitted back and forth between the fluid-ejection device 100 and the tip 102 via the electrical coupling of their electrical connectors 209 and 512 have stabilized. In one embodiment, this length of time may be 800 milliseconds. A second instance of the identification string of the tip 102 is then read by the fluid-ejection device 100 (1410). The second instance of the identification string should match the first instance of this string, such that the method 1400 proceeds from part 1404 to part 1412. However, where these two instances of the identification string are not identical, the fluid-ejection device 100 again performs parts 1406, 1408, and 1410.

In general, it is said that these performance of these parts 1406, 1408, and 1410 are repeated until one or more conditions are satisfied. The primary condition is that the two instances of the identification string of the tip 102 as read by the fluid-ejection device 100 are identical. However, a secondary condition may be that the identification string has been read a relatively large number of times, such as 100 times. Rather than repeatedly performing parts 1406, 1408, and 1410 in an endless loop, the fluid-ejection device may thus ultimately stop the loop of parts 1406, 1408, and 1410, even though the two instances of the identification string have never matched, and signal to the user that an error has occurred.

Ultimately, the method 1400 proceeds to part 1412, assuming that the two instances of the identification string of the tip 102 as read by the fluid-ejection device 100 match. Thus, the fluid-ejection device 100 selects parameters for the tip 102 based on the identification string of the tip 102 (1412). That is, the fluid-ejection device 100 selects a particular entry within a table of different types of tips that corresponds to the type of the tip 102 placed on the fluid-ejection device 100. Thereafter, subsequent ejection of fluid by the fluid-ejection mechanism 510 of the tip 102, such as by performing the method 700 of FIG. 7 or FIG. 9, is controlled by the fluid-ejection device 100 in accordance with these selected tip parameters.

Figure 15:
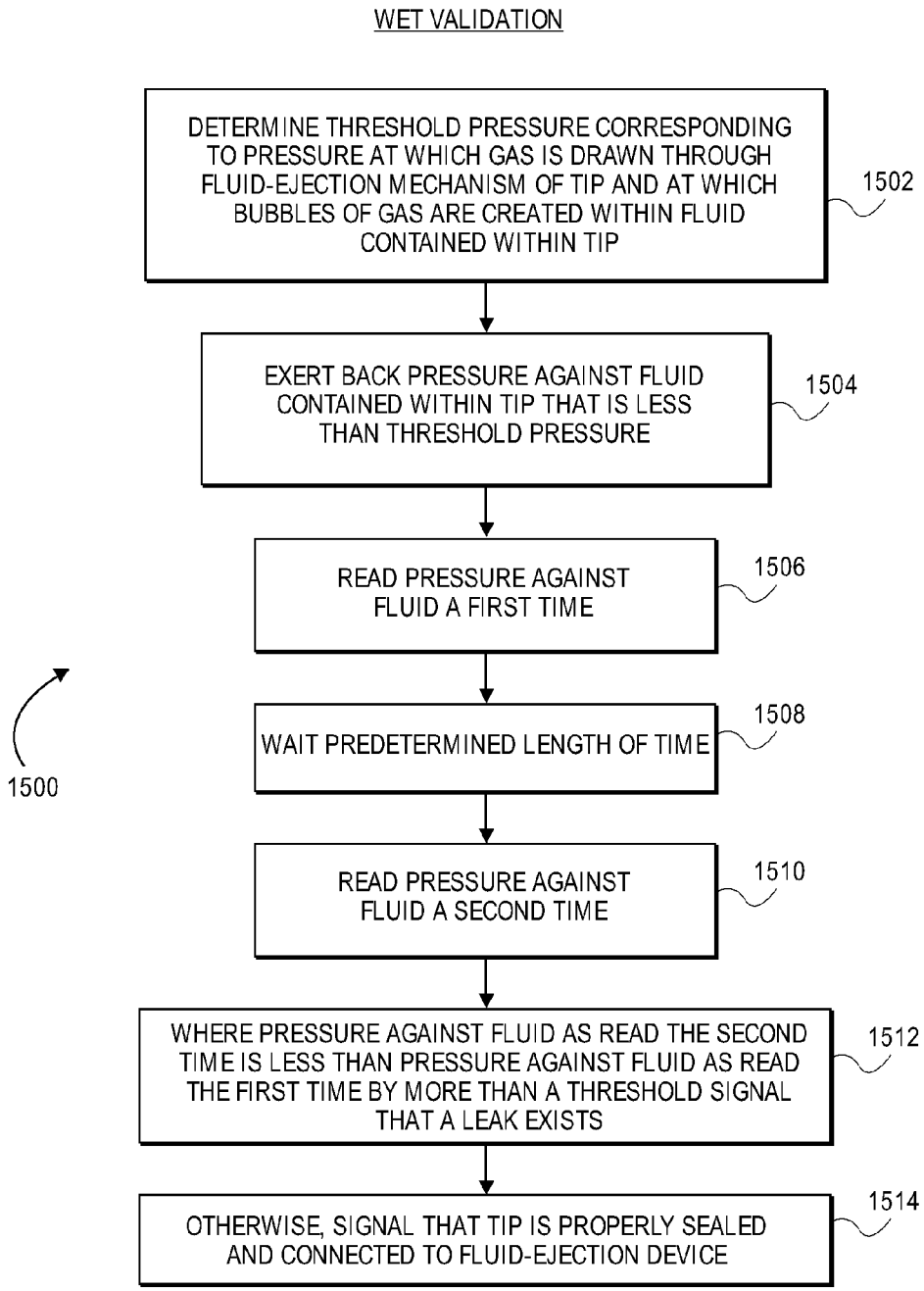
FIG. 15 is a flowchart of a method for wet validating a tip and/or a fluid-ejection device, according to an embodiment of the invention.

FIG. 15 shows a method 1500 for wet validating the tip 102 and/or the fluid-ejection device 100, while the tip 102 contains fluid, according to an embodiment of the invention. The method 1500 may be performed by an end user, or by the manufacturer of the tip 102 and/or the fluid-ejection device 100. The tip 102 may be validated by performing the method 1500 where it is already known that the fluid-ejection device 100 is valid, or the device 100 may be validated by performing the method 1500 where it is already known that the tip 102 is valid. Where it is not already known that either the fluid-ejection device 100 or the tip 102 is valid, then the combination of the device 100 and the tip 102 are validated by performing the method 1500.

First, the threshold pressure corresponding to the pressure at which gas, such as air, is drawn through the fluid-ejection mechanism 510 of the tip 102 and at which bubbles of the gas are created within the fluid contained within the tip 102 as a result is determined (1502). This determination may be made by reading the value in a table corresponding to the type of the tip 102 and/or the type of the fluid contained within the tip 102, or in another manner. This threshold pressure is more particularly described as follows.

When negative, or back, pressure is exerted against the fluid within the body 504 of the tip 102, any fluid remaining outside of the body 504 on the fluid-ejection mechanism 510 is drawn back into the body 504, as has been described. Furthermore, exerting negative pressure against the fluid within the body 504 ensures that the fluid does not undesirably drain or drip from the body 504 via the fluid-ejection mechanism 510 when the fluid-ejection mechanism 510 is not actively ejecting the fluid. However, if too much negative pressure is exerted against the fluid, then air or other gas from outside the tip 102 will be drawn into the body 504 of the tip 102 through the fluid-ejection mechanism 510. As a result, air or other gas bubbles will be created within the supply of fluid contained within the body 504. The negative, or back, pressure at which this situation occurs is the threshold pressure referred to here. The terms negative pressure and back pressure are used synonymously herein.

The method 1500 exerts back pressure against the fluid contained within the tip 102 that is less than this threshold pressure (1504). The back pressure may be exerted, for instance, by the pump 222 fluidically or pneumatically connected to the tip 102 via the gas channel 216 and the pneumatic fitting 220. The pressure against the fluid within the tip 102 is read a first time (1506), a predetermined length of time is waited (1508), and the pressure against the fluid within the tip 102 is read a second time (1510). The pressure may be read, for instance, by the pressure sensor 221 of the fluid-ejection device 100, which is fluidically or pneumatically coupled to the tip 102 via the gas channel 216 and the pneumatic fitting 220 of the fluid-ejection device 100. The predetermined length of time that is waited may be one-to-five seconds, or another length of time. The pressure that is read may be back pressure in one embodiment.

The purpose for taking two readings of the pressure against the fluid contained within the tip 102 at two different times separated by the predetermined length of time is to determine how much the pressure has changed during this predetermined length of time. If the pressure against the fluid within the tip 102 as read the second time is less than the pressure against the fluid as read the first time by more than a threshold, then this means that a leak exists within the tip 102 (1512), the fluid-ejection device 100, or in-between the tip 102 and the device 100, such that the former is not properly sealed to the latter. In such instance, the user is signaled that a leak exists.

Otherwise, the user is signaled that there are no leaks, and that the tip 102 is properly sealed and connected to the fluid-ejection device 100 (1514). That is, if the pressure against the fluid within the tip 102 as read the second time is not less than the pressure against the fluid as read the first time by more than the threshold, then no leaks exist. The negative or back pressure against the fluid within the tip 102 can naturally vary somewhat between the first and the second readings. This is why a threshold is employed to determine whether the pressure has dropped too much between the readings, which indicates that a leak exists.

Figure 16:
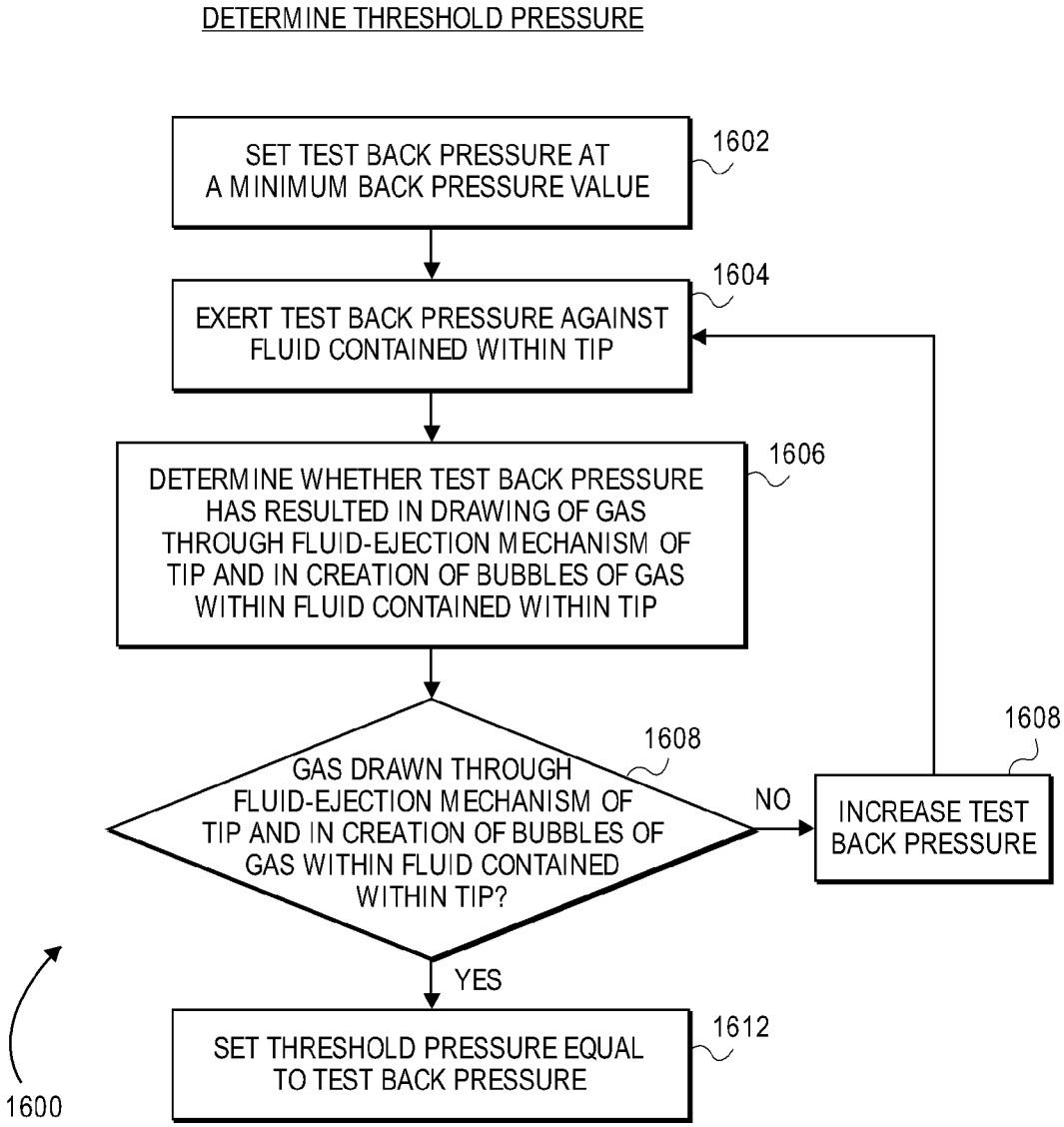
FIG. 16 is a flowchart of a method to determine a pressure at which air or another gas is drawn into a tip and at which air or other gas bubbles are created within the fluid contained within the tip, according to an embodiment of the invention.

FIG. 16 shows a method 1600 that can be employed in part 1502 of the method 1500 of FIG. 15 to determine the threshold pressure at which air or another gas is drawn into the tip 102 and at which air or other gas bubbles are created within the fluid contained within the tip 102, according to an embodiment of the invention. The method 1600 may be performed for each unique combination of a given type of the tip 102 and for a given type of fluid contained within the tip 102 to determine such a threshold pressure for each unique tip type and fluid type combination. The method 1600 is performed in relation to a tip 102 and a fluid-ejection device 100 on which the tip 102 is properly placed without leaks and that are known to have no internal leaks themselves.

A test back pressure is initially set at a minimum back pressure value (1602), at which it may be known that no gas is likely to be drawn into the tip 102 and no gas bubbles are likely to be created within the fluid contained within the tip 102, regardless of the type of the tip 102 or the type of fluid contained within the tip 102. Thereafter, the test back pressure is exerted against the fluid contained within the tip 102 (1604). The method 1600 determines whether the test back pressure exerted against the fluid has resulted in the drawing of gas through the fluid-ejection mechanism 510 of the tip 102 and in the creation of gas bubbles within the fluid contained within the tip 102 (1606).

For example, it may be known that when gas is drawn through the fluid-ejection mechanism 510 of the tip 102 and when gas bubbles are resultantly created within the fluid contained within the tip 102, the pressure against the fluid 102 varies by less than a threshold. This pressure change by less than a threshold may result regardless of the type of the tip 102 and regardless of the type of the fluid contained within the tip 102. Therefore, the pressure sensor 221 of the fluid-ejection device 100 can be employed to determine whether the test back pressure exerted has resulted in the drawing of gas through the fluid-ejection mechanism 510 and in the creation of gas bubbles within the fluid contained within the tip 102.

If the test back pressure exerted against the fluid contained within the tip 102 has not resulted in the drawing of gas through the fluid-ejection mechanism 510 of the tip 102 nor in the creation of gas bubbles within this fluid (1608), the test back pressure is increased by a predetermined amount (1610). The method 1600 then is repeated beginning at part 1604. At some point, the test back pressure exerted against the fluid results in the drawing of gas through the fluid-ejection mechanism 510 and in the creation of gas bubbles within the fluid contained within the tip 102 (1608). The threshold pressure is thus set equal to this test back pressure (1612).

In general, it is said that these performance of parts 1604, 1606, and 1610 are repeated until one or more conditions are satisfied. The primary condition is that gas is drawn through the fluid-ejection mechanism 510 and that air or other gas bubbles are resultingly created within the fluid contained within the tip 102. However, a secondary condition may be that the test back pressure may have been increased such that it is greater than a maximum threshold at which gas is drawn through the tip 102 and at which gas bubbles are created within the fluid contained within the tip 102, for any combination of the type of tip 102 and the type of fluid contained within the tip 102.

That is, at some point, the test back pressure may be so high that it can be effectively concluded that no gas will ever be drawn through the tip 102 and that no gas bubbles will be created within the fluid contained within the tip 102—or that an error has occurred. One such error may be that the fluid-ejection mechanism 510 is effectively sealed by dried fluid thereover, such that increasing the test back pressure past this maximum threshold is largely pointless. In one embodiment, then, rather than repeatedly performing parts 1604, 1606, and 1410 in an endless loop, the threshold pressure may be set to this maximum threshold for the test back pressure.

Figure 17:
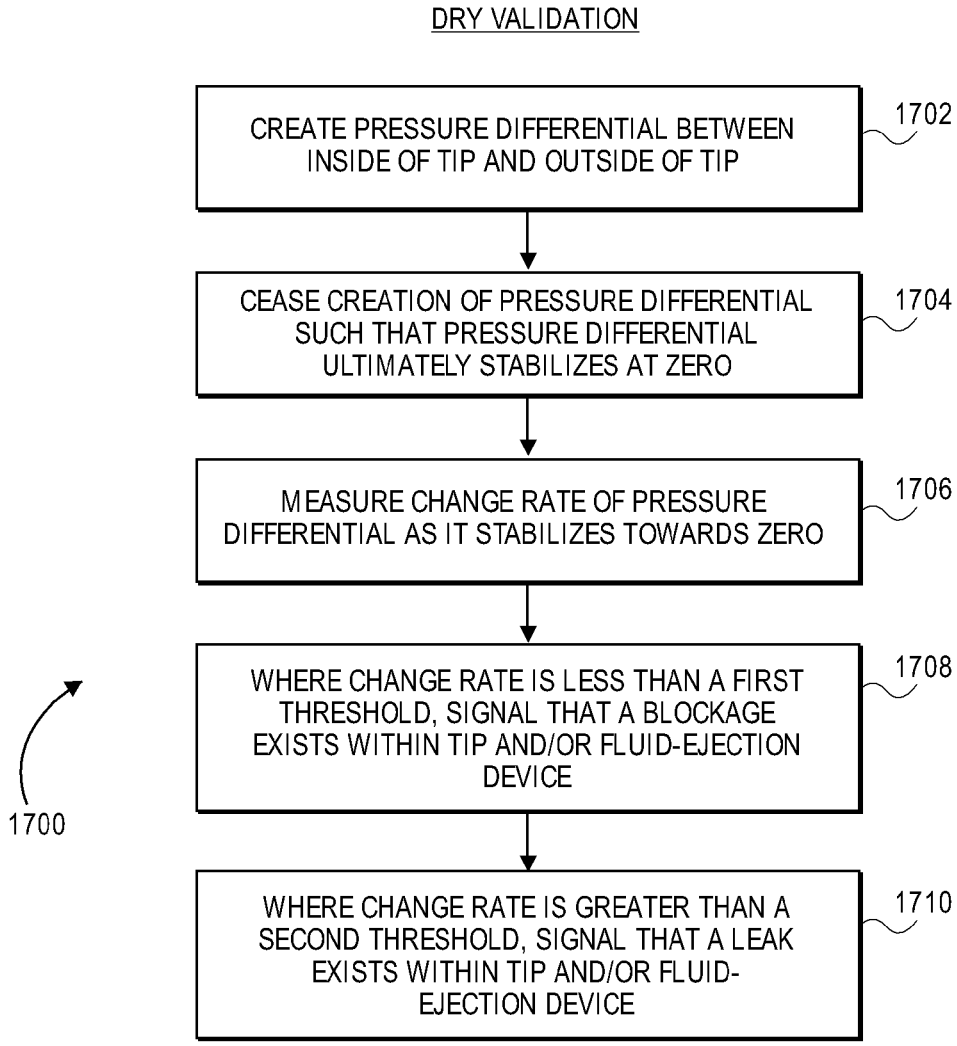
FIG. 17 is a flowchart of a method for dry validating a tip and/or a fluid-ejection device, according to an embodiment of the invention.

FIG. 17 shows a method 1700 for dry validating the tip 102 and/or the fluid-ejection device 100, where the tip 102 does not contain any fluid, according to an embodiment of the invention. The method 1700 may be performed by an end user, or by the manufacturer of the tip 102 and/or the fluid-ejection device 100. The tip 102 may be validated by performing the method 1700 where it is already known that the fluid-ejection device 100 is valid, or the device 100 may be validated by performing the method 1700 where it is already known that the tip 102 is valid. Where it is not already known that either the fluid-ejection device 100 or the tip 102 is valid, then the combination of the device 100 and the tip 102 are validated by performing the method 1700. The method 1700 is performed in relation to the tip 102 having been placed on the fluid-ejection device 100.

First, a predetermined pressure differential is created between the inside of the tip 102 and the outside of the tip 102 (1702). For example, the pump 222 fluidically or pneumatically connected to the tip 102 via the gas channel 216 and the pneumatic fitting 220 of the fluid-ejection device 100 may be employed to create a positive or a negative pressure differential between the interior of the body 504 of the tip 102 and the environment in which the tip 102 and the fluid-ejection device 100 are located. Air or another gas may be constantly pushed into the tip 102 via the pump 222 to create a positive pressure differential, so that the pressure within the tip 102 is greater than the pressure outside the tip 102 for at least a brief length of time. Alternatively, air or another gas may be constantly pulled from the tip 102 via the pump 222 to create a negative pressure differential, so that the pressure within the tip 102 is less than the pressure outside the tip 102 for at least a brief length of time.

Once a predetermined or constant pressure differential has been established by constant operation of the pump 222, for instance, the creation of the pressure differential ceases (1704). That is, the pump 222 may be turned off. As a result, the pressure differential between the inside of the tip 102 and the outside of the tip 102 begins to stabilize towards zero. This stabilization of the pressure differential towards zero results because air or another gas is naturally drawn through the nozzles of the fluid-ejection mechanism 510, such that the pressure outside and inside of the tip 102 becomes at least substantially equal. Without the pump 222 being turned on to maintain the constant pressure differential in one embodiment, or the predetermined pressure differential in another embodiment, the pressure differential naturally becomes zero, so that the inside of the tip 102 is at the same pressure as the outside of the tip 102.

The change rate of the pressure differential as it stabilizes towards zero is measured (1706). The pressure sensor 221 of the fluid-ejection device 100, for instance, may sample the pressure within the tip 102, via the fluidic connection of the sensor 221 with the tip 102 through the gas channel 216 and the pneumatic fitting 220, a number of times per second. The rate of change of the pressure differential as it stabilizes towards zero can be easily calculated from these pressure samples. Measuring the change rate of the pressure differential encompasses such sampling of the pressure within the tip 102 to determine the pressure differential.

Where the change rate is less than a first threshold, it can be concluded that a blockage exists within the tip 102 and/or the fluid-ejection device 100 (1708). That is, if air or another gas enters or exits the tip 102 too slowly (i.e., the change rate is less than the first threshold) to equalize the pressure inside the tip 102 with the pressure outside the tip 102, then this means that there is some type of blockage within the tip 102 and/or within the fluid-ejection device 100. The user is thus signaled that such a blockage exists.

By comparison, where the change rate is greater than a second threshold, it can be concluded that a leak exists within the tip 102 or the fluid-ejection device 100, or that the seal between the tip 102 and the device 100 is unsecure (1710). That is, if air or another gas enters or exits the tip 102 too quickly (i.e., the change rate is greater than the second threshold), to equalize the pressure inside the tip 102 with the pressure outside the tip 102, then this means that there is a leak within the tip 102 or the fluid-ejection device 100, or that the tip 102 is not properly coupled to the device 100. The user is thus signaled that such a leak exists.

Septum Embodiment

The tip 102 has been described thus far in the detailed description as being placed on the fluid-ejection device 100. More particularly, the tip 102 has been described thus far such that the body 504 of the tip 102, at the first end 506 thereof, is placed on the pneumatic fitting 220 of the fluid-ejection device 100. As can be appreciated by those of ordinary skill within the art, the tip 102 and/or the fluid-ejection device 100 can have further components, in addition to the body 504 and the pneumatic fitting 220, respectively, to provide for further advantages in operation of the tip 102 alone or in combination with the fluid-ejection device 100.

Figure 18A:
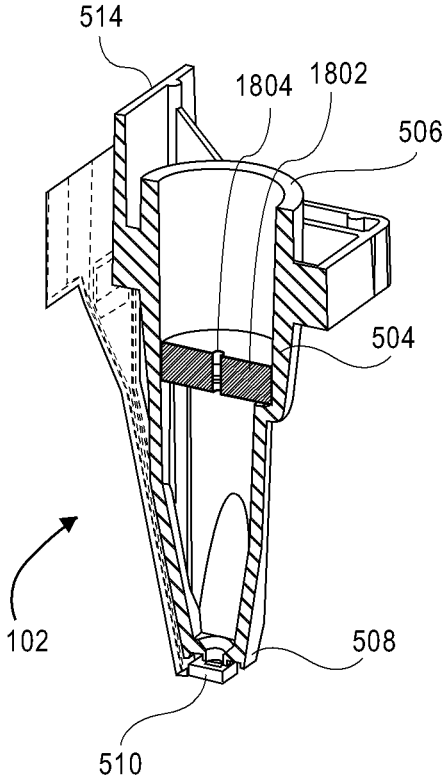
FIGS. 18A and 18B are diagrams of a tip having a septum and a corresponding fluid-ejection device having a hollow needle, respectively, according to an embodiment of the invention.
Figure 18B:
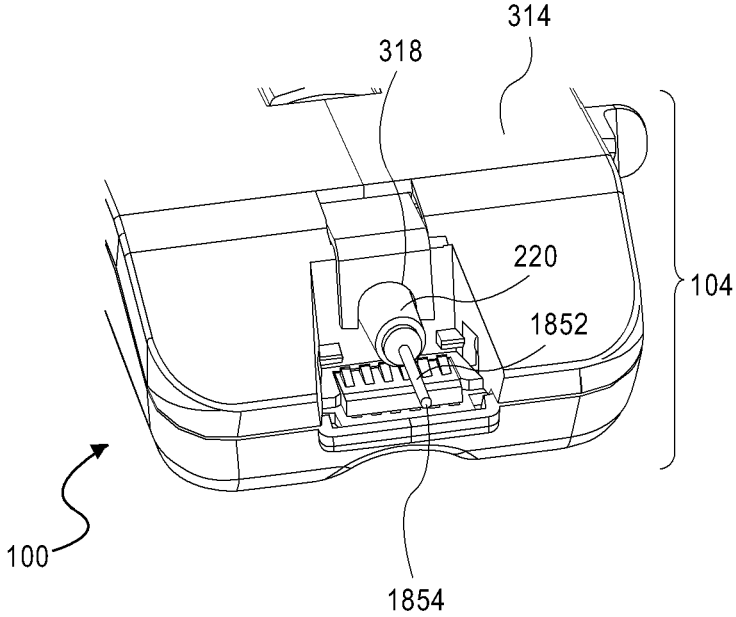

FIG. 18A shows the tip 102 as including a septum 1802, and FIG. 18B shows the fluid-ejection device 100 as including a hollow needle 1852, according to one such embodiment of the invention. FIG. 18A corresponds to FIG. 5B, in that FIG. 5B shows the tip 102 without the septum 1802, whereas FIG. 18A shows the tip 102 with the septum 1802. Otherwise, the tip 102 is identical between FIGS. 5B and 18A. However, not all the reference numbers called out in FIG. 5B are called out in FIG. 18A for illustrative clarity. Likewise, FIG. 18B corresponds to FIG. 3C, in that FIG. 3C shows the fluid-ejection device 100 without the hollow needle 1852, whereas FIG. 18B shows the device 100 with the needle 1852. Otherwise, the fluid-ejection device 100 is identically between FIGS. 3C and 18B. However, not all the reference numbers called out in FIG. 3C are called out in FIG. 18B for illustrative clarity.

In FIG. 18A specifically, the septum 1802 is inserted at and plugs the opening of the body 504 of the tip 102 at the first end 506 thereof. The septum 1802 itself has a small opening 1804 therein substantially at the center of the septum 1802 and that runs through the septum 1802 parallel to the centerline of the body 504 of the tip 102. The small opening 1804 is depicted in FIG. 18A as being a hole, but may alternatively be a slit. The septum 1802 may be fabricated from compressible rubber or another compliant material, and seals the tip 102 at the first end 506 of the body 504. When no object is inserted into the opening 1804, the septum 1802 self-seals therearound, so that no fluid can escape from the body 504 at the first end 506 thereof through the septum 1802. However, even though no object is disposed within the opening 1804 of the septum 1802 in FIG. 18A, the septum 1802 is not depicted as having self-sealed around the opening 1804, such that the opening 1804 is exaggerated in size, for illustrative clarity.

In FIG. 18B specifically, the hollow needle 1852 is inserted through and within the pneumatic fitting 220 extending through the enclosure 104 of the fluid-ejection device 100. The hollow needle 1852 ends in an opening 1854. The pneumatic fitting 220 is otherwise plugged, or sealed, except for the hollow needle 1852 inserted therein, in the embodiment of FIG. 18B. The hollow needle 1852 of the fluid-ejection device 100 corresponds to the septum 1802 of the tip 102, in that placing the tip 102 on the device 100 results in the needle 1852 piercing through the septum 1802 to fluidically or pneumatically connect the gas channel 216 of the device 100 to the body 504 of the tip 102. Therefore, it can be said that the septum 1802 of the tip 102 is receptive to and capable of being pierced by the hollow needle 1852 of the fluid-ejection device 100.

The utilization of the hollow needle 1852 within the fluid-ejection device 100 and of the septum 1802 within the tip 102 is advantageous for a number of reasons, three of which are described here. First, desired negative pressure can be maintained within the tip 102 even when the tip 102 is not on the fluid-ejection device 100. As such, the fluid is less likely to undesirably drain from the fluid-ejection mechanism 510 of the tip 102 when stored, or after being filled but before being placed on the fluid-ejection device 100. Second, the likelihood of undesired spillage of the fluid from the first end 506 of the body 504 of the tip 102 when the tip 102 is not on the fluid-ejection device 100 is substantially lessened. Third, when the tip 102 is placed on the fluid-ejection device 100, and the fluid-ejection device 100 is oriented so that the tip 102 is elevated as compared to the device 100, the likelihood of undesired contamination of the pneumatic fitting 220 and the gas channel 216 of the device 100 by fluid flowing from the tip 102 to the device 100 is substantially reduced.

Figure 19:
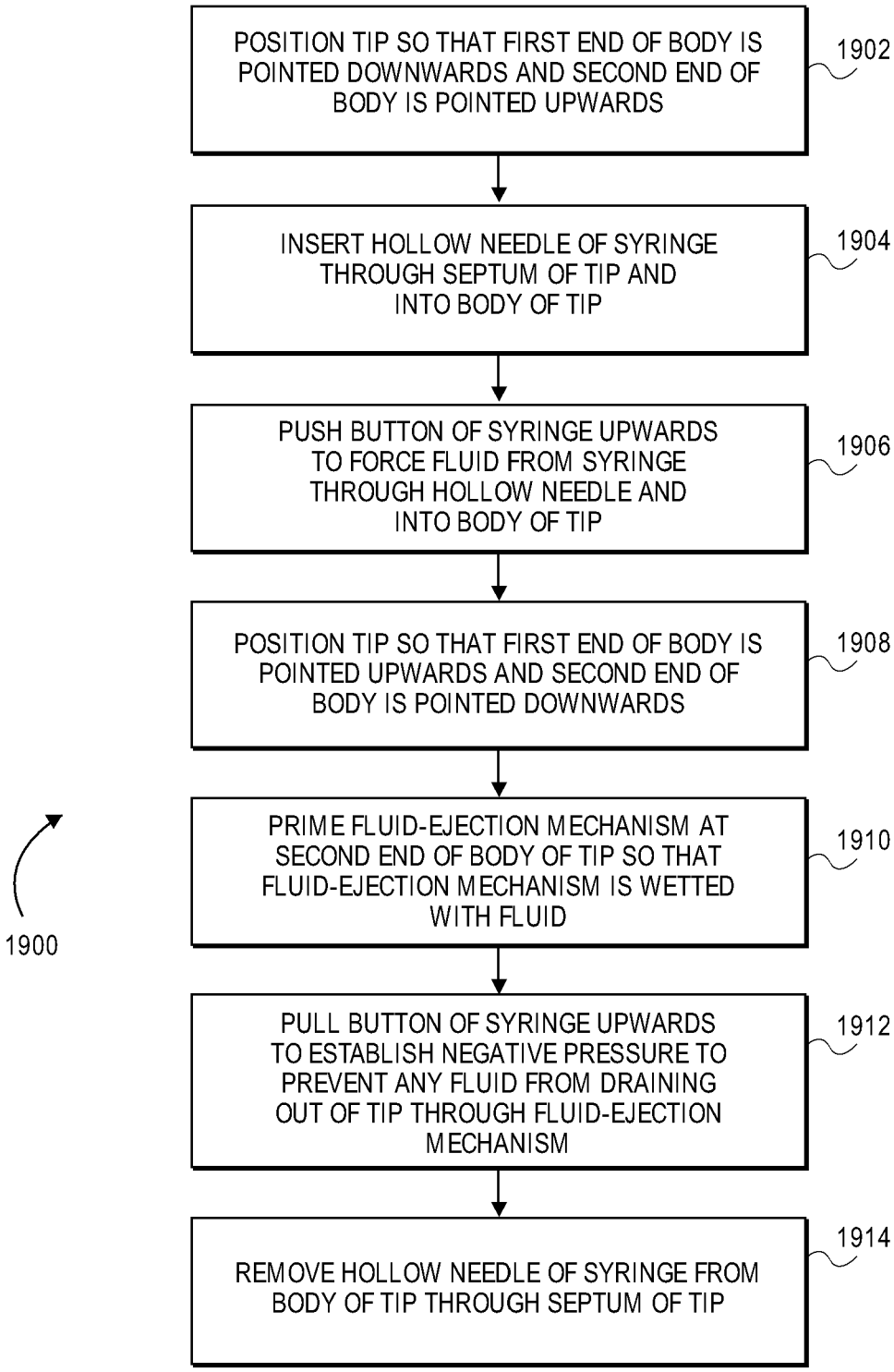
FIG. 19 is a flowchart of a method for filling with fluid a tip having a septum for placement on a fluid-ejection device, according to an embodiment of the invention.

FIG. 19 shows a method 1900 for filling the tip 102 with fluid, where the tip 102 includes the septum 1802, according to an embodiment of the invention. The tip 102 is positioned so that the first end 506 of the body 504 of the tip 102 is pointed downwards, and the second end 508 of the body 504 is pointed upwards (1902). The hollow needle of a syringe containing the fluid to be delivered to the tip 102 is inserted through the septum 1802 of the tip 102 (i.e., piercing the septum 1802) and into the body 504 of the tip 102 (1904). The button of the syringe is then pushed upwards to force the fluid from the syringe through its hollow needle and into the body 504 of the tip 102 (1906), via positive pressure.

Figure 20B:
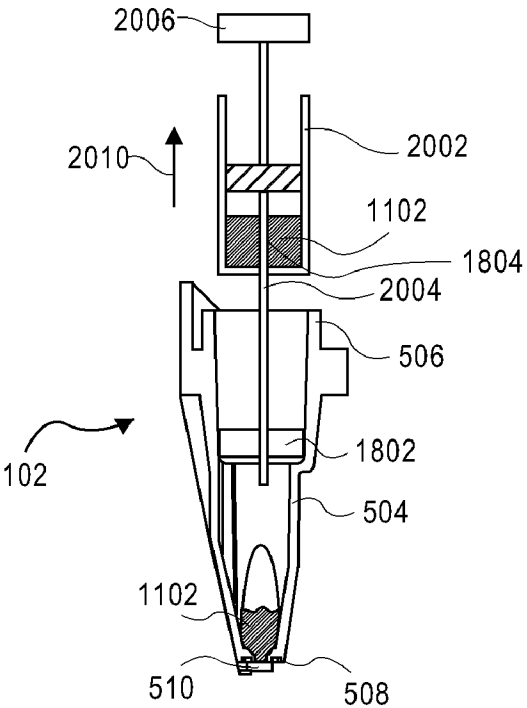
FIGS. 20A and 20B are diagrams depicting exemplary filling of a tip having a septum with fluid, according to varying embodiments of the invention.
Figure 20A:
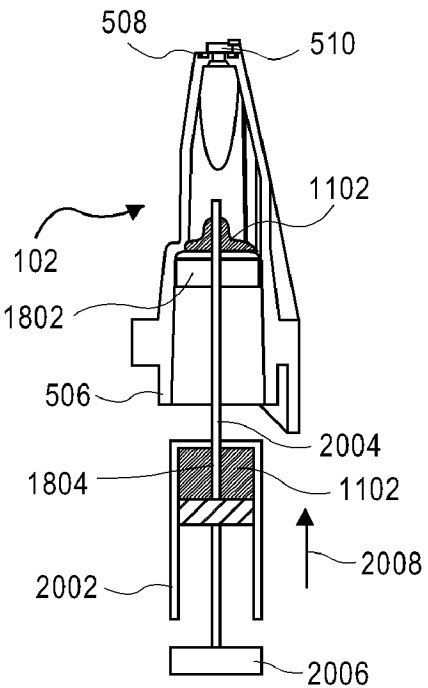

FIG. 20A shows illustrative performance of parts 1902, 1904, and 1906 of the method 1900 of FIG. 19, according to an embodiment of the invention. The tip 102 has been positioned or oriented so that the end 506 of the body 504 is pointed downwards, and the end 508 of the body 504 is pointed upwards. The hollow needle 2004 of the syringe 2002 containing the fluid 1102 to be delivered to the tip 102 has been inserted through the septum 1802 of the tip 102 and into the body 504 of the tip 102. A user has pushed the button 2006 in the upwards direction, as indicated by the arrow 2008, to force the fluid from the syringe 2002 through its hollow needle 2004 and into the body 504 of the tip 102.

Referring back to FIG. 19, the tip 102 is then positioned so that the first end 506 of the body 504 of the tip 102 is pointed upwards and the second end 508 of the body 504 is pointed downwards (1908). The fluid-ejection mechanism 510 at the second end 508 of the body 504 is primed by fluid naturally flowing down the interior of the body 504 until it reaches the mechanism 510 (1910), so that the fluid-ejection mechanism 510 is wetted with some of the fluid. Additionally, a slight positive pressure may be applied to achieve priming. Because the needle of the syringe is still inserted within the tip 102, just a small amount of the fluid at most drains out of the fluid-ejection mechanism 510 and away from the tip 102. The button of the syringe is pulled slightly upwards to establish a small amount of negative pressure against the fluid within the body 504 of the tip 102 (1912). This slight negative pressure substantially prevents any fluid from draining out of the tip 102 through the fluid-ejection mechanism 510 once the syringe has been removed from the tip 102. Finally, the hollow needle of the syringe is removed from the body 504 of the tip 102 through the septum 1802 of the tip 102 (1914).

FIG. 20B shows illustrative performance of parts 1908, 1910, and 1912 of the method 1900 of FIG. 19, according to an embodiment of the invention. The tip 102 has been positioned or oriented so that the end 506 of the body 504 is pointed upwards, and the end 508 of the body 504 is pointed downwards. The fluid 1102 has naturally flowed, via gravity and wicking action, to the end 508 of the body 504 at which the fluid-ejection mechanism 510 is disposed, such that the fluid-ejection mechanism 510 has been wetted with some of the fluid. A user has pulled the button 2006 of the syringe 2002 in the upwards direction, as indicated by the arrow 2010, to establish a small amount of negative pressure against the fluid 1102 within the body 504 of the tip 102.

We claim:

1. A method for using a tip capable of being placed on a fluid-ejection device comprising:

detecting whether the tip has been placed on the fluid-ejection device, such that an electrical connector of the fluid-ejection device has electrically coupled with an electrical connector of the tip;

repeating the steps of:

reading a first instance of an identification string of the tip via electrical coupling of the electrical connector of the fluid-ejection device and of the tip until the first instance of the identification string contains at least one binary zero and at least one binary one;

waiting a predetermined length of time;

reading a second instance of the identification string of the tip via the electrical coupling of the electrical connector of the fluid-ejection device and of the tip;

until one or more conditions have been satisfied, the conditions including the first instance of the identification string of the tip matching the second instance of the identification string of the tip.

2. The method of claim 1, wherein detecting whether the tip has been placed on the fluid-ejection device comprises detecting whether an open circuit is present at the electrical connector of the fluid-ejection device, which indicates an absence of the electrical coupling of the electrical connector of the fluid-ejection device and of the tip, or whether a closed circuit is present at the electrical connector of the fluid-ejection device, which indicates a presence of the electrical coupling of the electrical connector of the fluid-ejection device and of the tip.

3. The method of claim 1, wherein the method further comprising validating the tip and/or the fluid-ejection device where the tip contains a supply of fluid and a fluid-ejection mechanism disposed at an end of the tip has been wetted with the fluid, by the steps of:

exerting a back pressure against the fluid contained within the tip that is less than a threshold pressure corresponding to a pressure at which gas is drawn through the fluid-ejection mechanism at the end of the tip and at which bubbles of the gas within the fluid contained within the tip are created;

reading the pressure against the fluid contained within the tip a first time;

waiting a predetermined length of time;

reading the pressure against the fluid contained within the tip a second time;

where the pressure against the fluid contained with the tip as read the second time is less than the pressured against the fluid contained with the tip as read the first time by more then a predetermined threshold, signaling that a leak exists; and, otherwise, signaling that the tip is properly sealed and connected to the fluid-ejection device.

4. The method of claim 3, wherein the method further comprises determining the threshold pressure corresponding to the pressure at which the gas is drawn through the fluid-ejection mechanism at the end of the tip and at which the bubbles of the gas within the fluid contained within the tip are created.

5. The method of claim 4, wherein determining the threshold pressure corresponding to the pressure at which the gas is drawn through the fluid-ejection mechanism at the end of the tip and at which the bubbles of the gas within the fluid contained within the tip are created comprises:

setting a test back pressure at a minimum back pressure value;

repeating the steps of:

exerting the test back pressure against the fluid contained within the tip;

determining whether the test back pressure has resulted in drawing of the gas through the fluid-ejection mechanism at the end of the tip and in creation of bubbles of the gas within the fluid contained within the tip;

where the test back pressure has not resulted in drawing of the gas through the fluid-ejection mechanism at the end of the tip and in creation of bubbles of the gas within the fluid contained within the tip, increasing the test back pressure by a predetermined amount;

until one or more conditions have been satisfied, the conditions including the test back pressure having resulted in drawing of the gas through the fluid-ejection mechanism at the end of the tip and in creation of bubbles of the gas within the fluid contained within the tip; and, setting the test back pressure that resulted in drawing of the gas through the fluid-ejection mechanism at the end of the tip and in creation of bubbles of the gas within the fluid contained within the tip as the threshold pressure.

6. The method of claim 5, wherein determining whether the test back pressure has resulted in drawing of the gas through the fluid-ejection mechanism at the end of the tip and in creation of bubbles of the gas within the fluid contained within the tip comprises:

reading the pressure against the fluid contained within the tip; and, determining whether the pressure against the fluid contained within the tip has changed by less than a threshold pressure differential.

7. The method of claim 1, wherein the method further comprises validating the tip and/or the fluid-ejection device where the tip contains no fluid, by the steps of:

creating a pressure differential between inside of the tip and outside of the tip;

ceasing creation of the pressure differential between the inside of the tip and the outside of the tip, such that the pressure differential ultimately stabilizes at zero;

measuring a change rate of the pressure differential between the inside of the tip and the outside of the tip as the pressure differential stabilizes towards zero;

where the change rate is less than a first threshold, signaling that a blockage exists within one of the tip and the fluid-ejection device; and, where the change rate is greater than a second threshold, signaling that a leak exists within one of the tip and the fluid-ejection device.

* * * * *

UNITED STATES PATENT AND TRADEMARK OFFICE

CERTIFICATE OF CORRECTION

PATENT NO. : 7,578,591 B2
APPLICATION NO. : 11/532059
DATED : August 25, 2009
INVENTOR(S) : Blair M. Kent et al.

It is certified that error appears in the above-identified patent and that said Letters Patent is hereby corrected as shown below:

On the Title page, in field (54), Title, in column 1, line 1, delete "FILING" and insert -- FILLING --, therefor.

In column 1, line 1, delete "FILING" and insert -- FILLING --, therefor.

In column 25, line 30, in Claim 3, delete "comprising" and insert -- comprises --, therefor.

Signed and Sealed this

Thirtieth Day of March, 2010

David J. Kappos

David J. Kappos
*Director of the United States Patent and Trademark Office*